US012735289B2

(12) United States Patent
Sugiyama et al.

(10) Patent No.: US 12,735,289 B2
(45) Date of Patent: Sep. 15, 2026

(54) IMAGE FORMING APPARATUS CAPABLE OF REVERSING SHEET CONVEYANCE DIRECTION

(71) Applicant: CANON KABUSHIKI KAISHA, Tokyo (JP)

(72) Inventors: Yuki Sugiyama, Shizuoka (JP); Tadashi Fukumuro, Shizuoka (JP); Akira Matsushima, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 160 days.

(21) Appl. No.: 18/775,127

(22) Filed: Jul. 17, 2024

(65) Prior Publication Data

US 2025/0026600 A1 Jan. 23, 2025

(30) Foreign Application Priority Data

Jul. 20, 2023 (JP) ..... 2023-118515

(51) Int. Cl.

| | |
|---|---|
| ***B65H 29/60*** | (2006.01) |
| ***B65H 5/06*** | (2006.01) |
| ***B65H 7/02*** | (2006.01) |
| ***B65H 15/00*** | (2006.01) |

(52) U.S. Cl.

CPC ..... *B65H 29/60* (2013.01); *B65H 5/062* (2013.01); *B65H 7/02* (2013.01); *B65H 15/004* (2020.08); *B65H 2404/166* (2013.01); *B65H 2511/20* (2013.01); *B65H 2801/06* (2013.01)

(58) Field of Classification Search

CPC .. B65H 20/60; B65H 85/00; B65H 2404/166; B65H 2301/33312

See application file for complete search history.

(56) References Cited

U.S. PATENT DOCUMENTS 6,340,157 B1 * 1/2002 Watanabe ..... G03G 15/234 271/301
6,577,844 B2 * 6/2003 Kamei ..... G03G 15/234 399/301

(Continued)

FOREIGN PATENT DOCUMENTS

JP 2006290582 A 10/2006
JP 2007186283 A 7/2007

(Continued)

*Primary Examiner* — Howard J Sanders
(74) *Attorney, Agent, or Firm* — ROSSI, KIMMS & McDOWELL LLP

(57) ABSTRACT

A reverse roller pulls in a sheet from a first conveying path to a second conveying path by conveying the sheet in a first direction and deliver the sheet from the second conveying path to a third conveying path by reversing the conveyance direction of the sheet from the first direction to a second direction. A clutch transmits drive power of a motor to the reverse roller and controls a rotation direction of the reverse roller. A controller controls a reverse timing of the reverse roller according to an actual length of a sheet. A guidance member guides the sheet where an image is formed on a first surface from a first conveying path to a second conveying path and guides the sheet guided to the second conveying path to a third conveying path. The clutch further controls the guidance member.

16 Claims, 12 Drawing Sheets

(56) References Cited

U.S. PATENT DOCUMENTS

| | | | | |
|---|---|---|---|---|
| 8,408,537 | B2 * | 4/2013 | Katada | B41J 13/0045 399/373 |
| 9,946,211 | B2 | 4/2018 | Oyama | |
| 10,579,001 | B2 * | 3/2020 | Endoh | G03G 21/14 |
| 11,206,334 | B2 * | 12/2021 | Hagiwara | H04N 1/00572 |
| 12,454,436 | B2 * | 10/2025 | Ogino | B65H 5/062 |
| 2009/0224458 | A1 * | 9/2009 | Muratani | G03G 15/6579 271/3.14 |
| 2017/0308021 | A1 * | 10/2017 | Kato | G03G 21/206 |
| 2025/0110439 | A1 * | 4/2025 | Sugiyama | G03G 15/234 |
| 2026/0016779 | A1 * | 1/2026 | Seki | G03G 15/234 |

FOREIGN PATENT DOCUMENTS

| | | | |
|---|---|---|---|
| JP | 2008069001 | A | 3/2008 |
| JP | 2017105605 | A | 6/2017 |

* cited by examiner

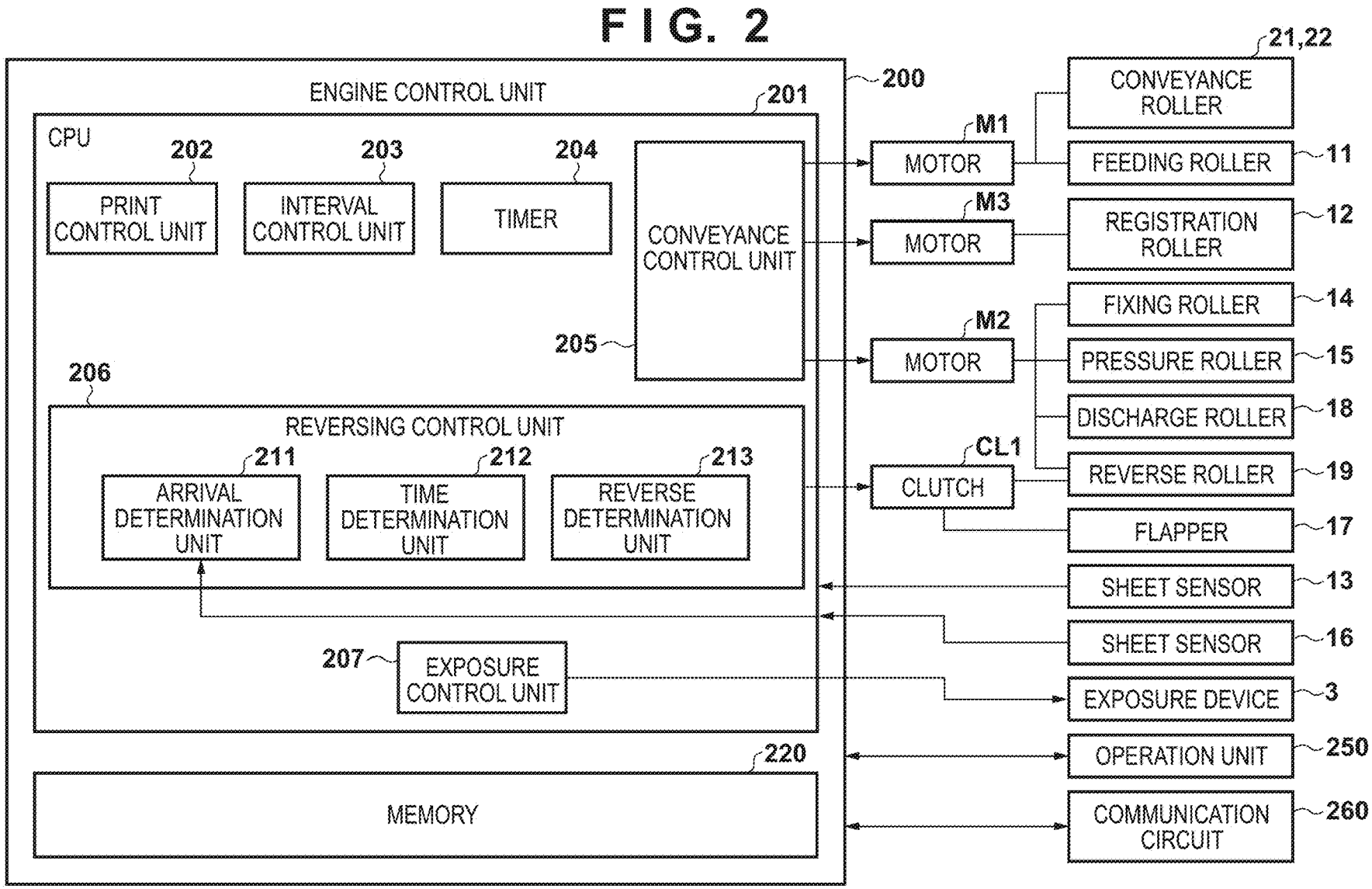
FIG. 2
21,22
CONVEYANCE ROLLER
11
FEEDING ROLLER
12
REGISTRATION ROLLER
14
FIXING ROLLER
15
PRESSURE ROLLER
18
DISCHARGE ROLLER
19
REVERSE ROLLER
17
FLAPPER
13
SHEET SENSOR
16
SHEET SENSOR
3
EXPOSURE DEVICE
250
OPERATION UNIT
260
COMMUNICATION CIRCUIT
M1
MOTOR
M3
MOTOR
M2
MOTOR
CL1
CLUTCH
200
201
ENGINE CONTROL UNIT
CPU
202
PRINT CONTROL UNIT
203
INTERVAL CONTROL UNIT
204
TIMER
CONVEYANCE CONTROL UNIT
205
206
REVERSING CONTROL UNIT
211
ARRIVAL DETERMINATION UNIT
212
TIME DETERMINATION UNIT
213
REVERSE DETERMINATION UNIT
207
EXPOSURE CONTROL UNIT
220
MEMORY

IMAGE FORMING APPARATUS CAPABLE OF REVERSING SHEET CONVEYANCE DIRECTION

BACKGROUND OF THE INVENTION

Field of the Invention

The present disclosure relates to an image forming apparatus capable of reversing the sheet conveyance direction.

Description of the Related Art

An image forming apparatus can form an image on both the front surface and the back surface of a sheet. This is referred to as double-sided printing. A sheet with an image formed on the front surface is passed through a loop-shaped conveying path (double-sided conveying path) provided in the image forming apparatus before an image is formed on the back surface. Note that a known method for inverting the front surface and the back surface of a sheet includes reversing the sheet conveyance direction (Japanese Patent Laid-Open No. 2006-290582).

With double-sided printing, the target printing speed (throughput) of the image forming apparatus is achieved by an image forming unit maintaining a constant period for passing the sheet through. If the timing of the reversing of the conveyance direction of a sheet with an image formed on the front surface is off from a specified timing, a misprint may occur and if may become difficult for the image forming apparatus to achieve the target printing speed. According to their research, the inventors found that, in a case where the actual length of a sheet is different from the expected length (nominal length), the reversing timing becomes slightly off, making the target printing speed unachievable.

SUMMARY OF THE INVENTION

The disclosure provides an image forming apparatus comprising: a housing case housing a sheet; a discharge tray configured to discharge the sheet; a first conveying path configured to connect the discharge tray from the housing case; an image forming unit configured to form an image on the sheet conveyed along the first conveying path; a second conveying path configured to branch from the first conveying path at a branch position provided downstream of the image forming unit in a conveyance direction of the sheet; a third conveying path configured to connect the second conveying path and the first conveying path and convey the sheet with an image formed on a first surface from the second conveying path to the first conveying path; a reverse roller configured to pull in the sheet from the first conveying path to the second conveying path by conveying the sheet in a first direction and deliver the sheet from the second conveying path to the third conveying path by reversing the conveyance direction of the sheet from the first direction to a second direction in order to change a surface where an image is formed by the image forming unit from the first surface to a second surface of the sheet; a motor configured to drive the reverse roller; a clutch configured to transmit drive power of the motor to the reverse roller and control a rotation direction of the reverse roller; a controller configured to control a reverse timing of the reverse roller according to an actual length of the sheet; and a guidance member configured to guide the sheet where an image is formed on the first surface from the first conveying path to the second conveying path and guide the sheet guided to the second conveying path to the third conveying path, wherein the clutch is further configured to control the guidance member.

Further features of the present disclosure will become apparent from the following description of exemplary embodiments (with reference to the attached drawings).

BRIEF DESCRIPTION OF THE DRAWINGS

FIG. 2 is a block diagram for describing an engine control unit.

DESCRIPTION OF THE EMBODIMENTS

Figure 1:
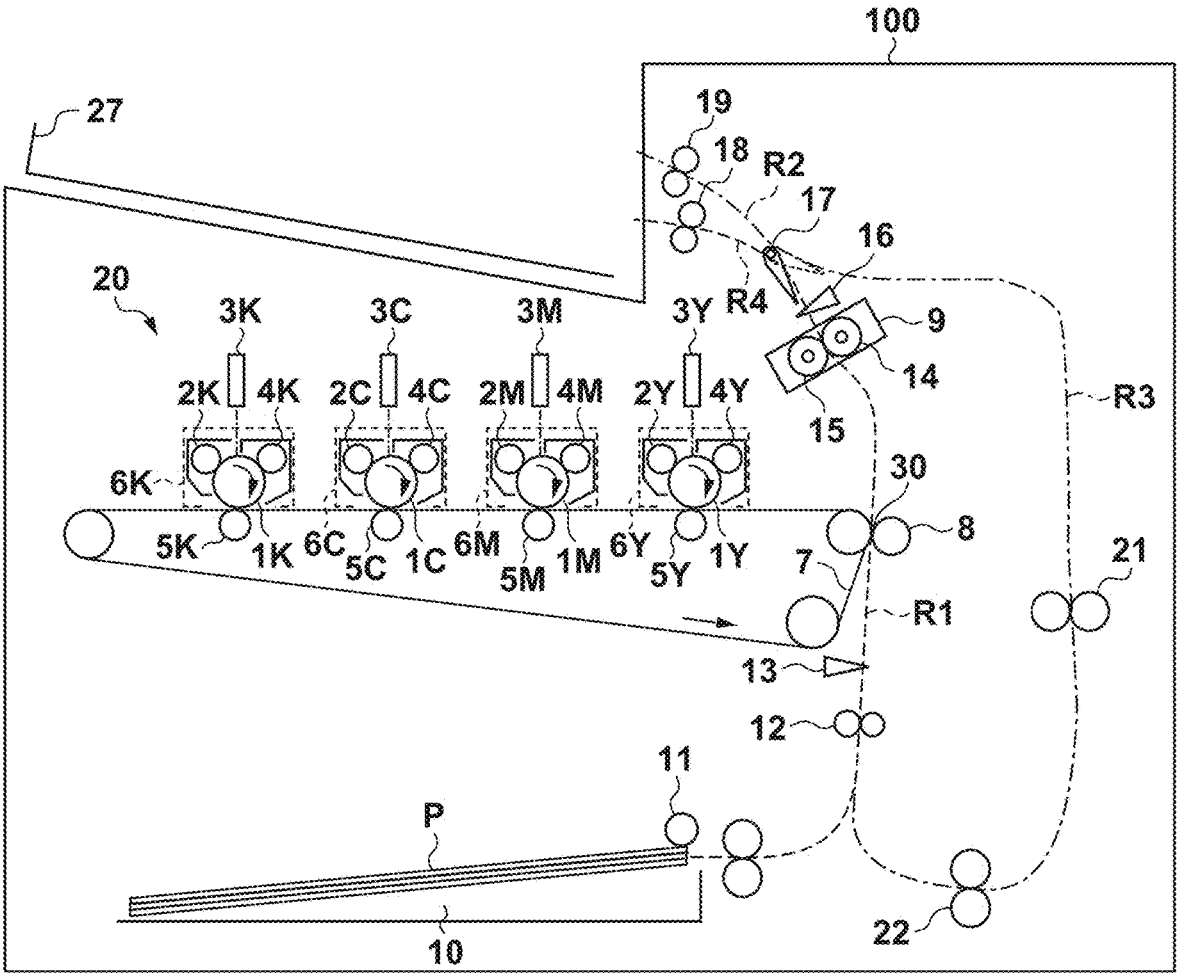
FIG. 1 is a diagram for describing an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment (1) Image Forming Apparatus

The image forming apparatus 100 is an electro-photographic laser printer, for example. The characters YMCK assigned to the ends of the reference signs indicate the toner colors of yellow, magenta, cyan, and black. When describing an item in common between the four colors, the characters YMCK are omitted from the reference signs.

An image forming unit 20 is a printer engine that forms a full color image using the YMCK toner on a sheet P. The image forming unit 20 includes a detachable process cartridge 6. The process cartridge 6 is integrally formed of a photosensitive drum 1, a charging device 2, and a developing device 4. The photosensitive drum 1 is an image carrier rotationally driven by a motor. The charging device 2 uniformly charges the surface of the photosensitive drum 1. An exposure device 3 is an exposure light source that emits laser light according to an image signal to the surface of the photosensitive drum 1 and forms an electrostatic latent image. The light source may be a semiconductor laser or may be an organic electroluminescent (EL) light-emitting diode. The developing device 4 develops the electrostatic latent image using the toner and forms a toner image. The developing device 4 may include a developing roller. A primary transfer member 5 transfers the toner image from the photosensitive drum 1 to an intermediate transfer belt 7. The primary transfer member 5 may be a primary transfer roller. The intermediate transfer belt 7 is an example of an intermediate transfer body that is rotationally driven to convey the toner image to a secondary transfer roller 8.

A sheet cassette 10 is a housing case that houses a plurality of the sheets P. A feeding roller 11 feeds the sheet P from the sheet cassette 10 to a first conveying path R1. A registration roller 12 conveys the sheet P to a secondary transfer unit.

A secondary transfer unit 30 is a nip portion formed by the intermediate transfer belt 7 and the secondary transfer roller 8. When the sheet P passes through the secondary transfer unit 30, the toner image is transferred from the intermediate transfer belt 7 to the sheet P. A fixing device 9 is provided downstream of the secondary transfer unit 30 in the conveyance direction of the sheet P. The fixing device 9 includes a fixing roller 14 and a pressure roller 15. The fixing roller 14 supplies heat to the sheet P and the toner image. The pressure roller 15 applies pressure to the sheet P and the toner image. This fixes the toner image on the sheet P. With single-sided printing, a flapper 17 guides the sheet P from the first conveying path R1 to a fourth conveying path R4. The fourth conveying path R4 may be referred to as a discharge conveying path. The fourth conveying path R4 may be considered as a part of the first conveying path R1, or the first conveying path R1 and the fourth conveying path R4 may be considered to form the main conveying path. The flapper 17 is a guidance member that switches the conveyance direction of the sheet P. A discharge roller 18 discharges the sheet P guided to the fourth conveying path R4 to a discharge tray 27.

With double-sided printing, the flapper 17 is a guidance member that guides the sheet P from the first conveying path R1 to a second conveying path R2. The second conveying path R2 branches from the first conveying path R1 at a branch position where the flapper 17 is provided. In this example, the first conveying path R1 branches into the second conveying path R2 and the fourth conveying path R4 at the branch position. The second conveying path R2 may be referred to as a reverse conveying path. A reverse roller 19 is a roller that can roll forward or backward with regard to the second conveying path R2. When the reverse roller 19 rotates in a first direction, the sheet P is pulled in and delivered from the first conveying path R1 to the second conveying path R2. When the trailing end of the sheet P arrives at a position (reversing position) where the sheet P can be fed in and delivered to a third conveying path R3, the reverse roller 19 rotates in a second direction. Accordingly, the trailing end of the sheet P becomes the leading end, and the sheet P is fed in and delivered to the third conveying path R3. The third conveying path R3 may be referred to as a conveying path for double-sided printing or a sub-conveying path. Note that the surface of the sheet P where the image is initially formed is referred to as a first surface. The surface of the sheet P on the opposite side to the first surface is referred to as a second surface. The sheet P includes a first end and a second end with respect to the conveyance direction of the sheet P. When the sheet P enters from the first conveying path R1 to the second conveying path R2, the first end of the sheet P corresponds to the leading end. When the sheet P enters from the second conveying path R2 to the third conveying path R3, the second end of the sheet P corresponds to the leading end. In this manner, by reversing the conveyance direction of the sheet P, the leading end of the sheet P switches between the first end and the second end. Also, the surface where the image is transferred onto the sheet P switches between the first surface and the second surface. This reversing method may be referred to as a switchback reversing method.

The flapper 17 switches at the same time as the reverse roller 19 reverses to guide the sheet P from the second conveying path R2 to the third conveying path R3. Conveyance rollers 21 and 22 provided on the third conveying path R3 convey the sheet P to the first conveying path R1. The third conveying path R3 is connected to the first conveying path R1 on the downstream side of the registration roller 12. The registration roller 12 conveys the sheet P that has been conveyed from the third conveying path R3 to the first conveying path R1 once again to the secondary transfer unit 30. In this manner, a toner image is formed on the second surface of the sheet P.

The sheet P is conveyed to the fixing device 9 where the toner image is fixed to the second surface. The flapper 17 guides the sheet P from the first conveying path R1 to the fourth conveying path R4. The discharge roller 18 discharges the sheet P to the discharge tray 27.

A sheet sensor 13 is provided between the registration roller 12 and the secondary transfer roller 8 and monitors the timing at which the sheet P is conveyed to the secondary transfer unit 30. In other words, the sheet sensor 13 is provided on the upstream side of the image forming unit 20. If the conveyance timing of the sheet P is later than a specified timing, the registration roller 12 temporarily accelerates. If the conveyance timing of the sheet P is earlier than a specified timing, the registration roller 12 temporarily decelerates. In this manner, the timing of when the toner image arrives at the secondary transfer unit 30 and the timing of when the sheet P arrives at the secondary transfer unit 30 are synchronized.

A sheet sensor 16 is a sensor disposed between the fixing device 9 and the flapper 17 that detects the leading end and the trailing end of the sheet P. For example, the timing of when the trailing end of the sheet P is detected by the sheet sensor 16 is used as the starting point for the timing of reversing the rotation direction of the reverse roller 19.

(2) Engine Control Unit

FIG. 2 illustrates an engine control unit 200. A CPU 201 implements various functions by executing a control program stored in a memory 220. Note that at least one or all of these functions may be implemented by an application-specific integrated circuit (ASIC), a field-programmable gate array (FPGA), or a similar piece of hardware.

A print control unit 202 controls motors M1, M2, and M3 via a conveyance control unit 205, controls a clutch CL1 via a reversing control unit 206, and controls an exposure device 3 via an exposure control unit 207. The print control unit 202 starts the printing processing on the basis of a printing instruction input from an operation unit 250 or a communication circuit 260. An interval control unit 203 controls the interval between image formations for implementing a target printing speed. The interval for image formations means the interval between exposure start timings for consecutively forming a yellow toner image on a plurality of pages, for example. The interval in double-sided printing is the amount of time from the front surface (first surface) exposure start timing to the back surface (second surface) exposure start timing. A timer 204 is used to monitor and manage the timing for image formation control, conveyance control, and the like.

The conveyance control unit 205 controls the motor M1 to drive the conveyance roller 21 and the feeding roller 11. Also, the conveyance control unit 205 controls the motor M2 to drive the fixing roller 14, the pressure roller 15, the discharge roller 18, and the reverse roller 19. In other words, the drive power generated by the motor M2 is transmitted to the reverse roller 19 and the like. The conveyance control unit 205 controls the motor M3 to drive the registration roller 12. The motor M3 and the registration roller 12 are used for acceleration/deceleration control of the sheet P. For example, the conveyance control unit 205 may temporarily accelerate or decelerate the conveyance speed of the sheet P on the basis of the timing of when the sheet sensor 13 detects the leading end of the sheet P. Accordingly, the conveyance speed of the sheet P is returned to a predetermined speed. The acceleration/deceleration control is performed to align the timing of when the toner image arrives at the secondary transfer unit 30 and the timing of when the sheet P arrives at the secondary transfer unit 30.

The reversing control unit 206 controls the clutch CL1 to switch the rotation direction of the reverse roller 19 and the position of the flapper 17. The reversing control unit 206 may include an arrival determination unit 211, a time determination unit 212, a reverse determination unit 213, and the like, for example. The arrival determination unit 211 determines whether or not the sheet sensor 16 has detected the leading end or the trailing end of the sheet P. The time determination unit 212 determines the timing to switch the conveyance direction of the sheet P. For example, the time determination unit 212 determines the conveyance time from the timing of when the trailing end of the sheet P is detected by the sheet sensor 16 to the timing for switching the conveyance direction of the sheet P. The reverse determination unit 213 monitors the timer 204 and waits for the timing (reverse timing) determined by the time determination unit 212 to arrive. For example, when the amount of time measured by the timer 204 matches the conveyance time determined by the time determination unit 212, the reverse determination unit 213 switches the clutch CL1 from on to off. Accordingly, the reverse roller 19 is switched from forward rotation to reverse rotation. The conveyance direction of the sheet P is reversed, and the sheet P is fed in and delivered from the second conveying path R2 to the third conveying path R3. Also, the position of the flapper 17 is switched from the position for guiding the sheet P to the fourth conveying path R4 to the position for guiding the sheet P to the third conveying path R3. On the other hand, when the clutch CL1 is switched from off to on, the reverse roller 19 rotations forward, and the flapper 17 moves to a position for guiding the sheet P to the fourth conveying path R4. Accordingly, the sheet P is guided from the first conveying path R1 to the fourth conveying path R4 and discharged to the discharge tray 27.

The exposure control unit 207 controls the exposure device 3 on the basis of an instruction from the print control unit 202. Note that as illustrated in FIG. 1, the exposure device 3Y for yellow toner initially starts exposure. Next, the exposure device 3M for magenta toner starts exposure. Then, the exposure device 3C for cyan toner starts exposure. Last, the exposure device 3K for black toner starts exposure. Thus, for the start timing for image formation as described below, the exposure device 3Y is a reference. Each exposure start timing of the remaining exposure devices 3M, 3C, and 3K are determined using the exposure start timing of the exposure device 3Y as a reference. In this manner, a yellow toner image, a magenta toner image, a cyan toner image, and a black toner image are transferred onto the intermediate transfer belt 7 with accurate alignment.

(3) Flowchart (3-1) Basic Image Forming Processing

Figure 3A:
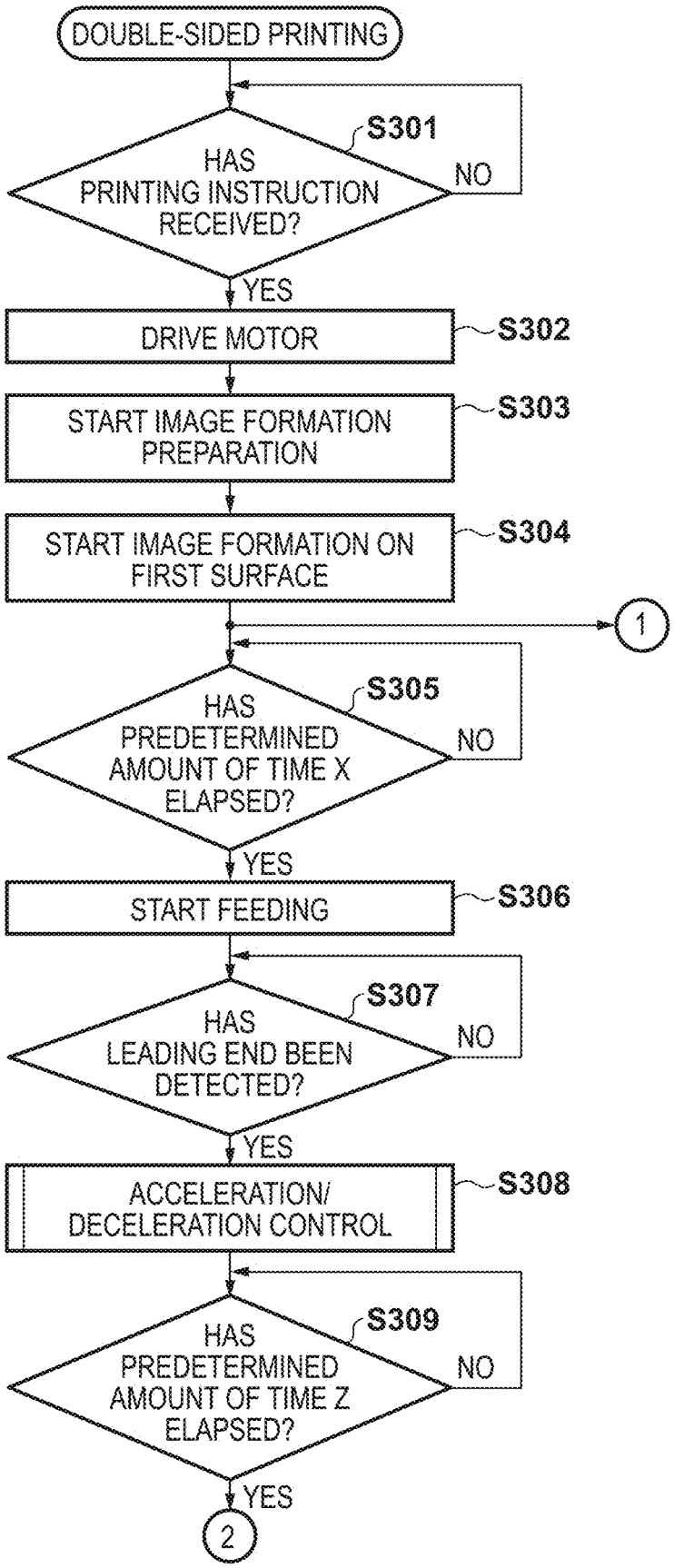
FIGS. 3A and 3B are a flowchart illustrating conveyance control.
Figure 3B:
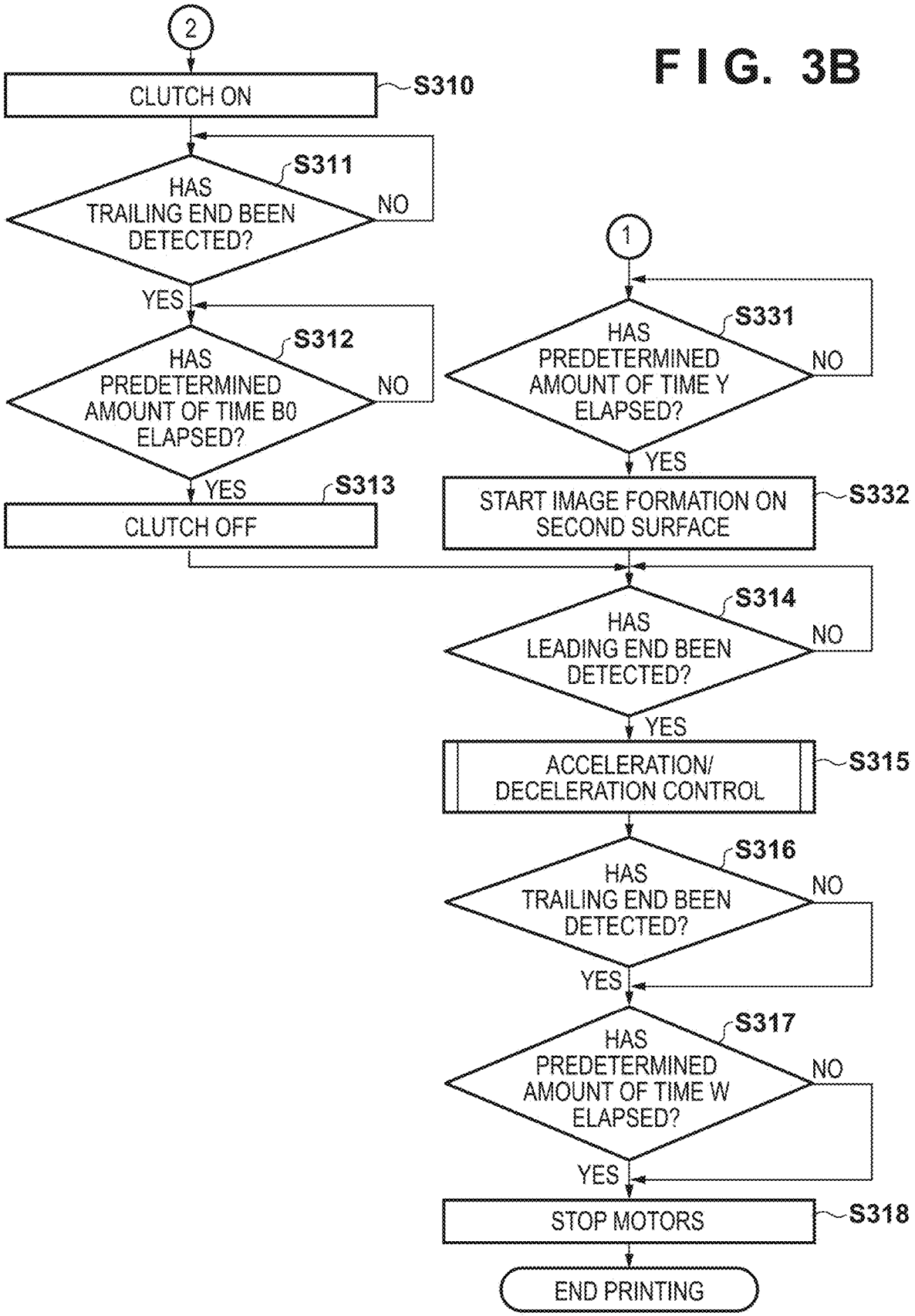

FIGS. 3A and 3B illustrate the conveyance control executed by the CPU 201 according a control program.

In S301, the CPU 201 (print control unit 202) determines whether or not a printing instruction has been received via the operation unit 250 or the communication circuit 260. If a printing instruction has been received from a host computer or the like via the communication circuit 260, the CPU 201 proceeds from S301 to S302.

In S302, the CPU 201 (print control unit 202 and conveyance control unit 205) drives the motors M1 and M2.

In S303, the CPU 201 (print control unit 202) starts image formation preparation. Image formation preparation includes, for example, adjusting the laser light amount of the exposure device 3 to a target light amount, controlling the rotational speed of the rotating polygon mirror of the exposure device 3 to a target speed, controlling the rotational speed of a rotary body such as the photosensitive drum 1 and the intermediate transfer belt 7 to a target speed, and the like.

In S304, the CPU 201 (print control unit 202 and exposure control unit 207) starts image formation on the first surface (front surface) of the sheet P. For example, the print control unit 202 supplies an image signal to the exposure control unit 207. The exposure control unit 207 starts outputting laser light according to the image signal. In this manner, an electrostatic latent image for the first surface is formed on the photosensitive drum 1. Thereafter, the electrostatic latent image is developed into a toner image which is then conveyed to the secondary transfer roller 8 via the intermediate transfer belt 7. Hereinafter, the series of processing from S305 to S313 is executed in parallel with the series of processing from S331 to S332.

(3-1-1) From S305 to S313

In S305, the CPU 201 (print control unit 202) determines whether or not a predetermined amount of time X has elapsed since the point in time of the start of forming the electrostatic latent image for the first surface. The predetermined amount of time X is the amount of time from the time of the start of forming the electrostatic latent image to the time of the start of feeding the sheet P. The predetermined amount of time X is predetermined and stored in the memory 220. The predetermined amount of time X may be calculated from the following formula Eq1.

$$X = Xi - Xp \qquad \text{Eq 1}$$

Here, Xi is the ideal amount of time from time to of the start of forming the electrostatic latent image to time t2 when the toner image arrives at the secondary transfer roller 8. Xp is the ideal amount of time from time t1 when the sheet P is feed from the sheet cassette 10 to time t2 when the leading end of the sheet P arrives at the secondary transfer roller 8. In the first embodiment, the amount of time Xi is longer than the amount of time Xp. Thus, after image formation has started, feeding of the sheet P where the image is to be transferred is started. When the predetermined amount of time X has elapsed, the CPU 201 proceeds from S305 to S306.

In S306, the CPU 201 (print control unit 202 and conveyance control unit 205) controls a non-illustrated solenoid or the like, lowers the feeding roller 11, and starts feeding the sheet P via the feeding roller 11. At this time, the feeding roller 11 rotates at a rotational speed that allows the sheet P to be conveyed at a predetermined conveyance speed (specified speed V). Thus, when the feeding roller 11 comes into contact with the sheet P, the sheet P is conveyed at the specified speed V.

In S307, the CPU 201 (print control unit 202) determines whether or not the leading end of the sheet P has been detected by the sheet sensor 13. When the leading end of the sheet P is detected, the CPU 201 proceeds from S307 to S308.

In S308, the CPU 201 (conveyance control unit 205) executes acceleration/deceleration control according to the timing at which the leading end of the sheet P was detected. The acceleration/deceleration control will be described below in detail using FIG. 4. While the sheet P passes through the secondary transfer unit 30, the sheet P is conveyed at the specified speed V. Note that the toner image is also conveyed at the specified speed V by the intermediate transfer belt 7.

In S309, the CPU 201 (print control unit 202) determines whether or not a predetermined amount of time Z has elapsed since the time when the acceleration/deceleration control ended. The predetermined amount of time Z is stored in the memory 220 in advance. The predetermined amount of time Z is the amount of time from the time when the acceleration/deceleration control ended to the time when the clutch CL1 is switched from off to on. When the predetermined amount of time Z has elapsed, the CPU 201 proceeds from S309 to S310.

In S310, the CPU 201 (reversing control unit 206) turns the clutch CL1 on. Accordingly, the flapper 17 moves to a position for guiding the sheet P from the first conveying path R1 to the second conveying path R2. Also, the rotation direction of the reverse roller 19 switches from reverse rotation to forward rotation. Accordingly, the sheet P is pulled in and delivered from the first conveying path R1 to the second conveying path R2.

In S311, the CPU 201 (arrival determination unit 211) determines whether or not the trailing end (second end) of the sheet P has been detected by the sheet sensor 16. When the trailing end of the sheet P is detected by the sheet sensor 16, the CPU 201 proceeds from S311 to S312.

In S312, the CPU 201 (reverse determination unit 213) determines whether or not a predetermined amount of time B0 has elapsed since the time when the trailing end of the sheet P was detected by the sheet sensor 16. The predetermined amount of time B0 is obtained by the following formula Eq2.

$$B0 = Lb \div V \qquad \text{Eq 2}$$

Here, V is the conveyance speed (specified speed) of the sheet P. Lb is the distance from the sheet sensor 16 to the reversing position and is obtained by the following formula Eq3.

$$Lb = Lfr - Lr \qquad \text{Eq 3}$$

Here, Lr is the distance from the reversing position to the reverse roller 19. Lr is 15 mm, for example. Lfr is the distance from the sheet sensor 16 to the reverse roller 19. In a case where Lr is 15 mm, a position 15 mm away from the reverse roller 19 on the upstream side corresponds to the reversing position. The conveyance direction of the sheet P is reversed at the time when the trailing end (second end) of the sheet P arrives at the reversing position. When the predetermined amount of time B0 has elapsed, the CPU 201 proceeds from S312 to S313.

In S313, the CPU 201 (reverse determination unit 213) turns the clutch CL1 off. Accordingly, the flapper 17 moves to a position for guiding the sheet P from the second conveying path R2 to the third conveying path R3. Also, the rotation direction of the reverse roller 19 switches from forward rotation to reverse rotation to reverse the conveyance direction of the sheet P. Accordingly, the sheet P is conveyed along the third conveying path R3 toward the first conveying path R1 with the second end as the leading end. Thereafter, the CPU 201 proceeds from S313 to S314.

(3-1-2) From S331 to S332

In S331, the CPU 201 (print control unit 202) determine whether or not a predetermined amount of time Y has elapsed since time t2 when the leading end of the sheet P arrives at the secondary transfer roller 8. The predetermined amount of time Y is the amount of time from time t2 when the leading end of the sheet P where the toner image is to be transferred on the first surface arrived at the secondary transfer roller 8 to time t9 when formation of an electrostatic latent image for the second surface is started. The predetermined amount of time Y is predetermined and stored in the memory 220. The predetermined amount of time Y may be calculated from the following formula Eq4.

$$Y = Yp1 + Yp2 + Yp3 \qquad \text{Eq 4}$$

Here, Yp1 is the ideal conveyance time required for moving the leading end (first end) of the sheet P where the image is to be formed on the first surface from the secondary transfer roller 8 to the reversing position. Yp2 is the ideal conveyance time obtained by dividing the nominal length of the sheet P by the conveyance speed (specified speed V). Yp3 is the ideal conveyance time required for the leading end (second end) of the sheet P where the image is to be formed on the first surface to arrive at the secondary transfer roller 8 from the reversing position via the third conveying path R3. Note that in order to reverse the conveyance direction of the sheet P, the leading end with respect to the conveyance direction of the sheet P is switched from the first end to the second end. When the predetermined amount of time Y has elapsed, the CPU 201 proceeds from S331 to S332.

In S332, the CPU 201 (print control unit 202 and exposure control unit 207) starts image formation on the second surface (back surface) of the sheet P. For example, the print control unit 202 supplies an image signal to the exposure control unit 207, and the exposure control unit 207 starts outputting laser light according to the image signal. In this manner, an electrostatic latent image for the second surface is formed on the photosensitive drum 1. Thereafter, the electrostatic latent image is developed into a toner image which is then conveyed to the secondary transfer roller 8 via the intermediate transfer belt 7. The CPU 201 proceeds from S332 to S314.

(3-1-3) From S314 to S318

In S314, the CPU 201 (conveyance control unit 205) determines whether or not the leading end (second end) of the sheet P has been detected by the sheet sensor 13. When the leading end (second end) of the sheet P is detected, the CPU 201 proceeds from S314 to S315.

In S315, the CPU 201 (conveyance control unit 205) executes acceleration/deceleration control. The acceleration/deceleration control in S315 is similar to the processing of the acceleration/deceleration control in S308. Thus, the time when the toner image to be transferred onto the second surface arrives at the secondary transfer roller 8 and the time when the sheet P that arrived via the third conveying path R3 arrives at the secondary transfer roller 8 are synchronized.

In S316, the CPU 201 (print control unit 202) determines whether or not the trailing end (first end) of the sheet P has been detected by the sheet sensor 16. When the trailing end (first end) of the sheet P is detected, the CPU 201 proceeds from S316 to S317.

In S317, the CPU 201 (print control unit 202) determines whether or not a predetermined amount of time W has elapsed since the time when the trailing end (first end) of the sheet P was detected by the sheet sensor 16. The predetermined amount of time W is the conveyance time from the time when the trailing end (first end) of the sheet P is detected to the time when the sheet P is discharged to the discharge tray 27. When the predetermined amount of time W has elapsed, the CPU 201 proceeds from S317 to S318.

In S318, the CPU 201 (conveyance control unit 205) stops the motors M1 and M2.

(3-2) Acceleration/Deceleration Control

Figure 4:
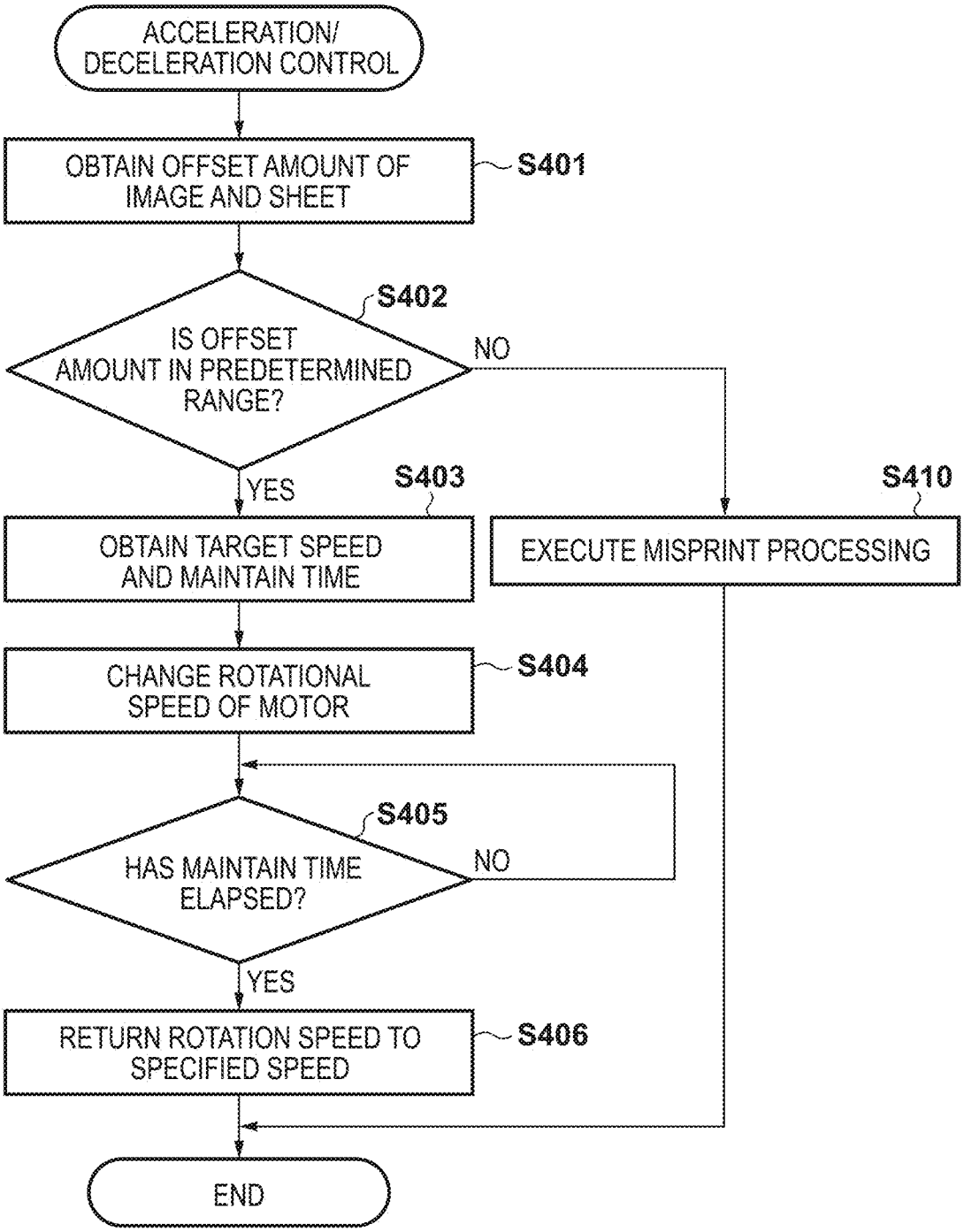
FIG. 4 is a flowchart illustrating acceleration/deceleration control.

FIG. 4 illustrates the acceleration/deceleration control executed by the CPU 201 according to a control program. The acceleration/deceleration control corresponds to S308 and S315 illustrated in FIGS. 3A and 3B.

In S401, the CPU 201 (conveyance control unit 205) obtains an offset amount of the leading end of the sheet P with respect to the position of the leading end of the toner image. For example, the conveyance control unit 205 obtains the difference between the time when the image formation started and the time when the leading end of the sheet P arrived at the sheet sensor 13. Also, the conveyance control unit 205 obtains the offset amount by multiplying the specified conveyance speed (specified speed V) by this difference.

In S402, the CPU 201 (conveyance control unit 205) determines whether or not the offset amount is within a predetermined range. The predetermined range is determined according to the acceleration/deceleration performance of the motor M1. In other words, the predetermined range is the range of the offset amount that can be resolved by acceleration/deceleration control executed while the leading end of the sheet P is being conveyed from the sheet sensor 13 to the secondary transfer roller 8. If the offset amount is not within the predetermined range, the CPU 201 proceeds from S402 to S410. In S410, the CPU 201 executes misprint processing. For example, the CPU 201 stops the motors M1 and M2 and displays a message on the operation unit 250 prompting for the misprinted sheet P to be removed from the image forming apparatus 100. If the offset amount is within the predetermined range, the CPU 201 proceeds from S402 to S403.

In S403, the CPU 201 (conveyance control unit 205) obtains the target speed of the motor M1 and a maintain time T. The maintain time T is the amount of time the rotational speed of the motor M1 is maintained at the target speed.

In S404, the CPU 201 (conveyance control unit 205) changes the rotational speed of the motor M1 to the target speed. Also, the CPU 201 measures the elapsed time from the time when the rotational speed is changed to the target speed by the timer 204.

In S405, the CPU 201 (conveyance control unit 205) determines whether or not the maintain time T has elapsed on the basis of the timer 204. When the maintain time T has elapsed, the CPU 201 proceeds from S405 to S406.

In S406, the CPU 201 (conveyance control unit 205) returns the rotational speed of the motor M1 to the specified speed V. In this manner, the sheet P is passed through the secondary transfer unit 30 at the specified speed V.

(4) Regarding the Difference Between Actual Length and Nominal Length of Sheet P With the control method illustrated in FIGS. 3A and 3B, it is assumed that the actual length of the sheet P fed from the sheet cassette 10 matches the length (nominal length) of the sheet P designated by the printing instruction. However, in some cases, the user makes a mistake when operating the operation unit 250, the sheet P with a length different from the nominal length is housed in the sheet cassette 10, and the like. In such cases, such an assumption does not hold up. Also, depending on manufacture variation in the sheets P, the actual length and the nominal length of the sheets P may be different.

For example, the actual length of the sheet P housed in the sheet cassette 10 may be longer than the nominal length of the sheet P designated by the user in the printing instruction. In such a case, in S311, the timing of when the trailing end (second end) of the sheet P is detected by the sheet sensor 16 is later than the specified timing. As a result, the timing of when the leading end (second end) of the sheet P where the image is to be formed on the first surface arrives again at the sheet sensor 13 is also delayed.

On the other hand, in order to provide a printed product to the user in a short amount of time, the CPU 201 determines the predetermined amount of time Y from the size information of the sheet P included in the printing instruction. Then, the CPU 201 starts the image formation for the second surface at the point in time when the predetermined amount of time Y elapses. In a case where the actual length of the sheet P is longer than the nominal length, the offset amount described above increases, and the offset amount may become unresolvable via the acceleration/deceleration control. Note that also in a case where the actual length of the sheet P is shorter than the nominal length, the offset amount described above increases, and the offset amount may become unresolvable via the acceleration/deceleration control. In this manner, a larger difference between the actual length and the nominal length increases the possibility of a misprint occurring due to an increase in the offset amount.

(5) Enhanced Flowchart

Figure 5:
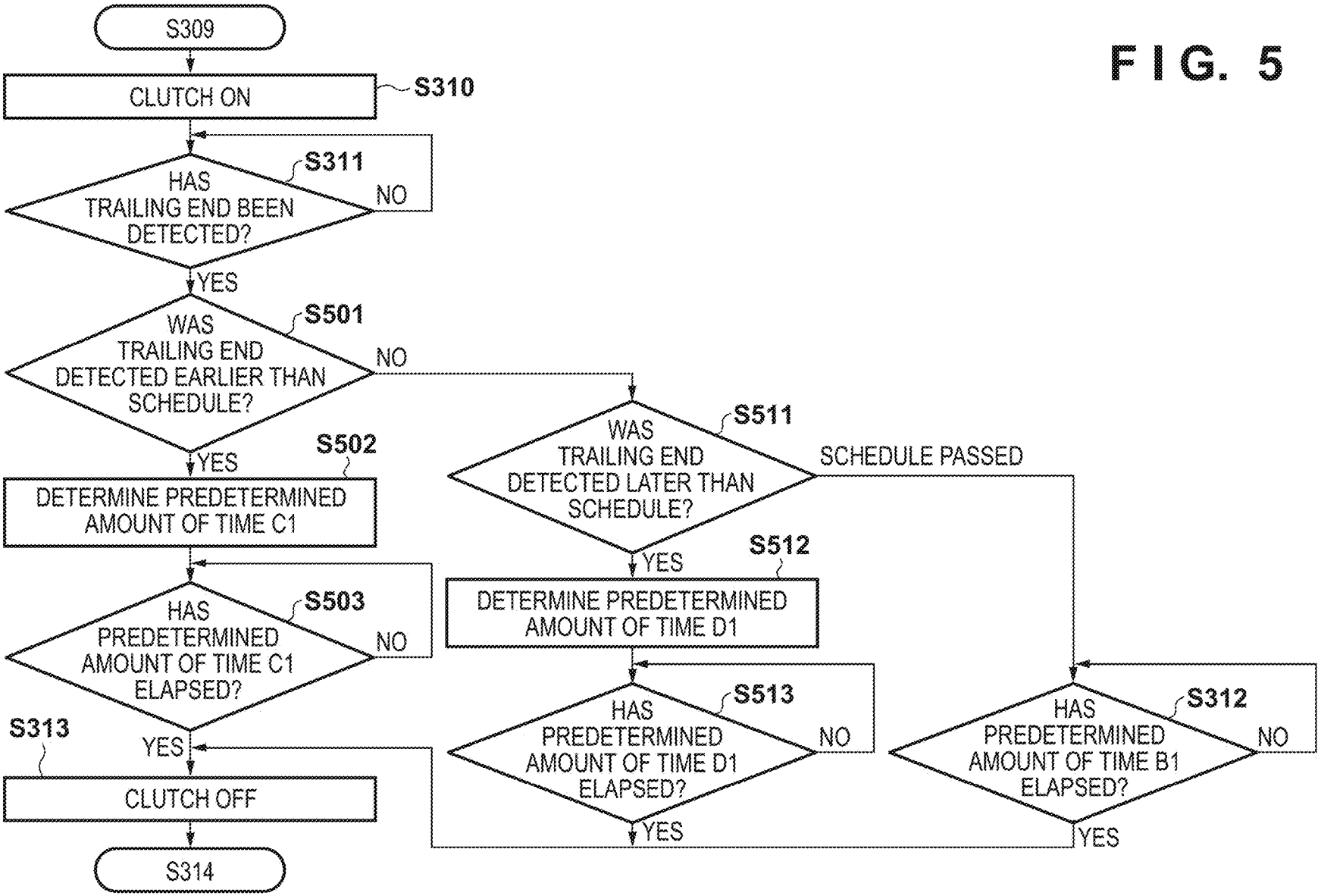
FIG. 5 is a flowchart illustrating a method for adjusting reverse timing.

FIG. 5 is a flowchart for solving the problem based on the difference between the actual length and the nominal length of the sheet P. Note that FIG. 5 illustrates only a portion of the flowchart illustrated in FIGS. 3A and 3B. The steps not illustrated in FIG. 5 are similar to the steps illustrated in FIGS. 3A and 3B. The processing from S311 to S313 according to FIG. 5 is enhanced as follows. In S311, when the trailing end of the sheet P is detected by the sheet sensor 16, the CPU 201 proceeds from S311 to S501.

In S501, the CPU 201 (arrival determination unit 211) determines whether or not the trailing end (second end) of the sheet P has been detected by the sheet sensor 16 earlier than scheduled. For example, the CPU 201 (time determination unit 212) obtains a scheduled timing Tp for the trailing end of the sheet P to arrive at the sheet sensor 16 using the start time (time t0) of image formation as a reference. The scheduled timing Tp is an example of a detection timing estimated from the nominal length of the sheet P.

$$Tp = Xi + Xf + Yp2 \quad \text{Eq 5}$$

Here, Xi is the ideal amount of time from time to of the start of forming the electrostatic latent image to time t2 when the toner image arrives at the secondary transfer roller 8. Xf is the ideal amount of time required for the leading end of the sheet P to be conveyed from the secondary transfer roller 8 to the sheet sensor 16. Yp2 is the ideal conveyance time obtained by dividing the nominal length of the sheet P by the conveyance speed (specified speed V). The arrival determination unit 211 monitors the scheduled timing Tp using the timer 204. The arrival determination unit 211 determines whether or not the timing (actual timing Tr) of when the sheet P actually arrived at the sheet sensor 16 is earlier than the scheduled timing Tp. If the actual timing Tr is earlier than the scheduled timing Tp, the CPU 201 proceeds from S501 to S502.

In S502, the CPU 201 (time determination unit 212) calculates a predetermined amount of time C1. The predetermined amount of time C1 is obtained by the following formula Eq6.

$$C1 = B0 + (Tp - Tr) \div 2 \quad \text{Eq 6}$$

In S503, the CPU 201 (reverse determination unit 213) determines whether or not the predetermined amount of time C1 has elapsed since the timing when the trailing end of the sheet P arrived at the sheet sensor 16 on the basis of the timer 204. When the predetermined amount of time C1 has elapsed, the CPU 201 proceeds from S503 to S313, and the clutch CL1 is turned off.

On the other hand, in S501, if the trailing end of the sheet P is not detected earlier than scheduled, the CPU 201 proceeds from S501 to S511.

In S511, the CPU 201 (arrival determination unit 211) determines whether or not the trailing end (second end) of the sheet P has been detected by the sheet sensor 16 later than scheduled. For example, the arrival determination unit 211 determines whether or not the actual timing Tr is after the scheduled timing Tp. If the trailing end (second end) of the sheet P is not detected later than scheduled, the CPU 201 proceeds from S511 to S312. On the other hand, if the trailing end (second end) of the sheet P is detected later than scheduled, the CPU 201 proceeds from S511 to S512.

In S512, the CPU 201 (time determination unit 212) calculates a predetermined amount of time D1. The predetermined amount of time D1 is obtained by the following formula Eq7.

$$D1 = B0 - (Tr - Tp) \div 2 \quad \text{Eq 7}$$

In such a case where the actual length of the sheet P is not the nominal length, half of the difference may be subtracted from the predetermined amount of time B0.

In S513, the CPU 201 (reverse determination unit 213) determines whether or not the predetermined amount of time D1 has elapsed since the timing when the trailing end of the sheet P arrived at the sheet sensor 16 on the basis of the timer 204. When the predetermined amount of time D1 has elapsed, the CPU 201 proceeds from S513 to S313, and the clutch CL1 is turned off.

Figure 6A:
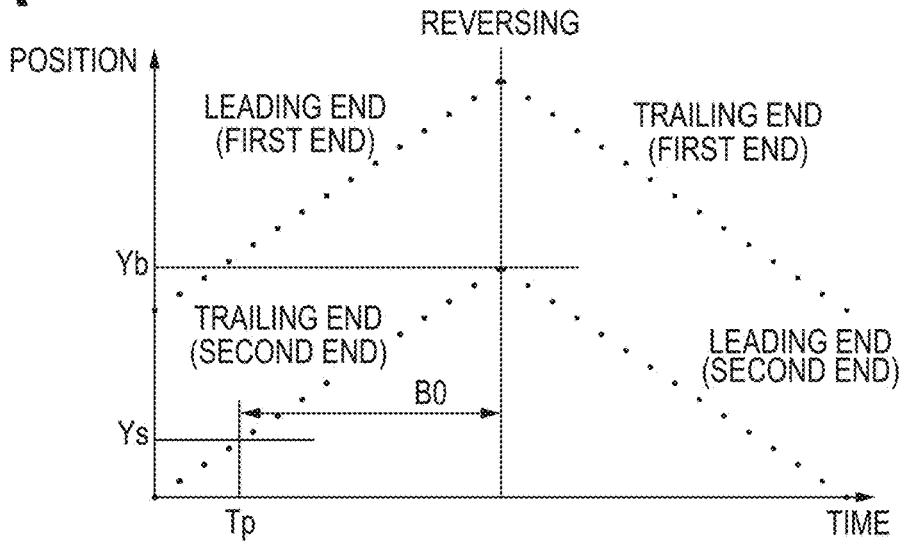
FIGS. 6A to 6C are timing charts for describing a case where the actual length of a sheet is shorter than the nominal length.
Figure 6B:
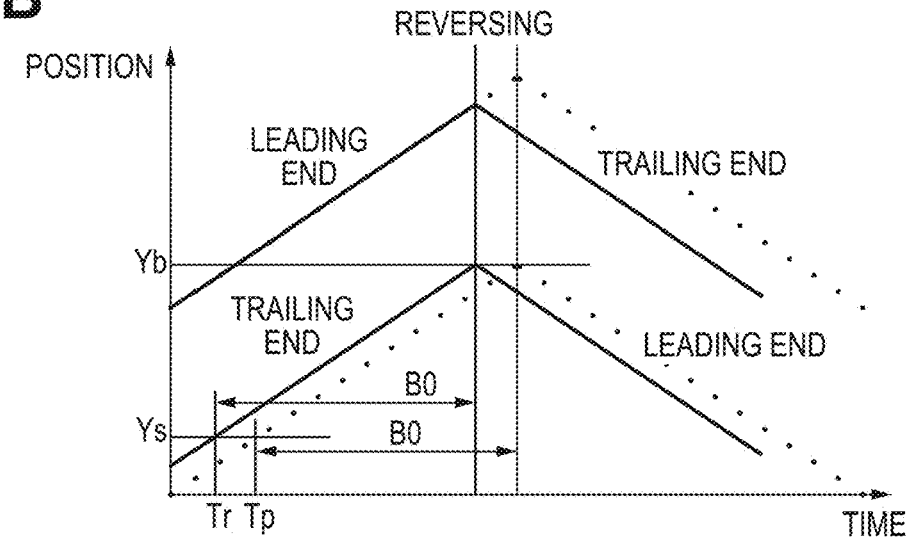
Figure 6C:
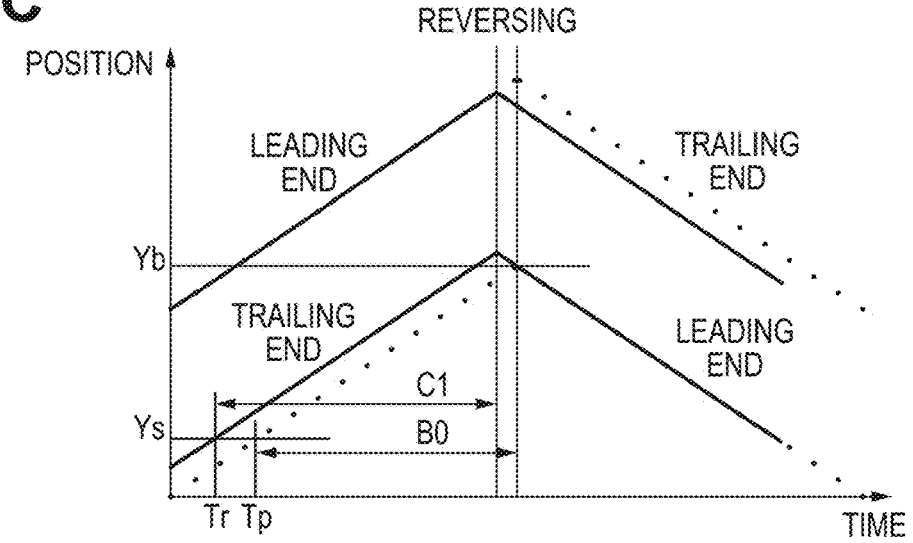

(6) Timing Chart (6-1) Example where Actual Length is Shorter than Nominal Length of Sheet P The positions of the sheet P in the reverse processing is illustrated in FIGS. 6A, 6B, and 6C. The horizontal axis represents time. The vertical axis represents the position of the sheet P. As illustrated in FIG. 6A, the dashed line represents the case where the actual length is the same as the nominal length of the sheet P. The trailing end of the sheet P arrives at a detection position Ys of the sheet sensor 16 at the scheduled timing Tp. When the predetermined amount of time B0 has elapsed since the scheduled timing Tp, the trailing end of the sheet P arrives at an ideal reversing position Yb. Here, the conveyance direction of the sheet P is reversed. Accordingly, the second end is switched from the trailing end to the leading end, and the first end is switched from the leading end to the trailing end. Thereafter, the sheet P is conveyed to the third conveying path R3.

FIG. 6B illustrates a case (solid line) where the actual length is shorter than the nominal length of the sheet P and the reverse timing has not been corrected. In a case where the actual length is shorter than the nominal length of the sheet P, the timing Tr of when the trailing end of the sheet P arrives at the sheet sensor 16 is before the scheduled timing Tp.

The conveyance direction of the sheet P is reversed at a timing corresponding to the predetermined amount of time B0 from the actual timing Tr. As a result, the reverse timing of FIG. 6B is before the reverse timing of FIG. 6A.

FIG. 6C illustrates a case (solid line) where the actual length is shorter than the nominal length of the sheet P and the reverse timing has been appropriately corrected. When the predetermined amount of time C1 has elapsed since the actual timing Tr, the conveyance direction of the sheet P is reversed. As a result, the position and the conveyance timing (dashed line) of the leading end (second end) in a case where the actual length and the nominal length are equal and the position and conveyance timing (solid line) of the leading end (second end) in a case where the actual length is shorter than the nominal length match.

(6-2) Example where Actual Length is Longer than Nominal Length of Sheet P

Figure 7A:
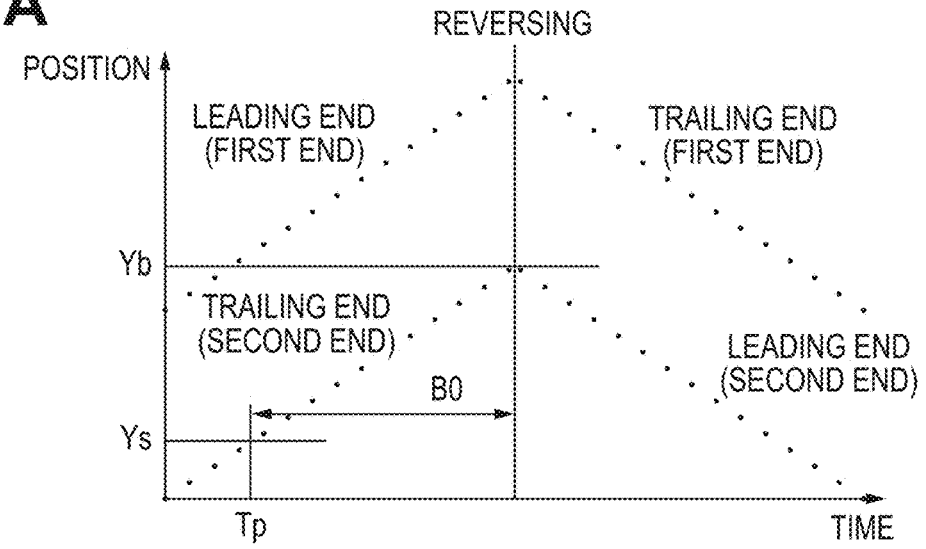
FIGS. 7A to 7C are timing charts for describing a case where the actual length of a sheet is longer than the nominal length.
Figure 7B:
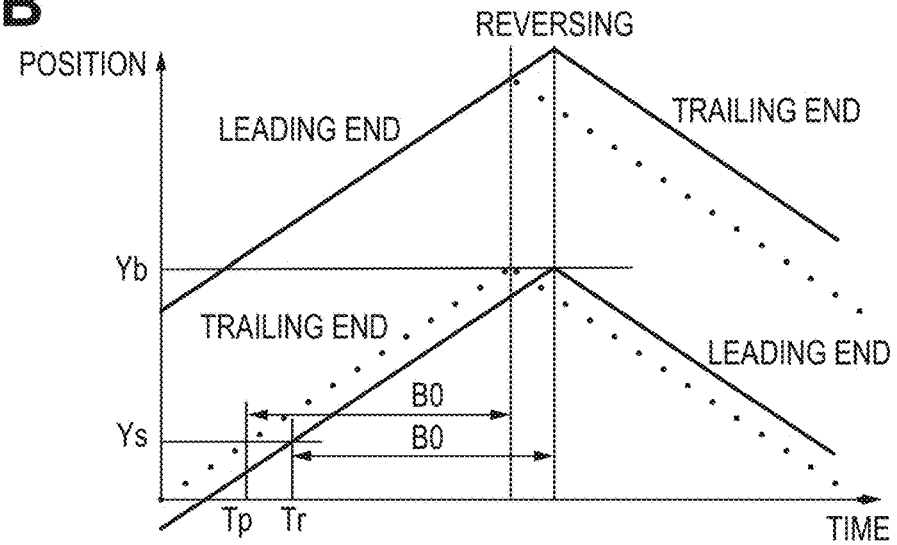
Figure 7C:
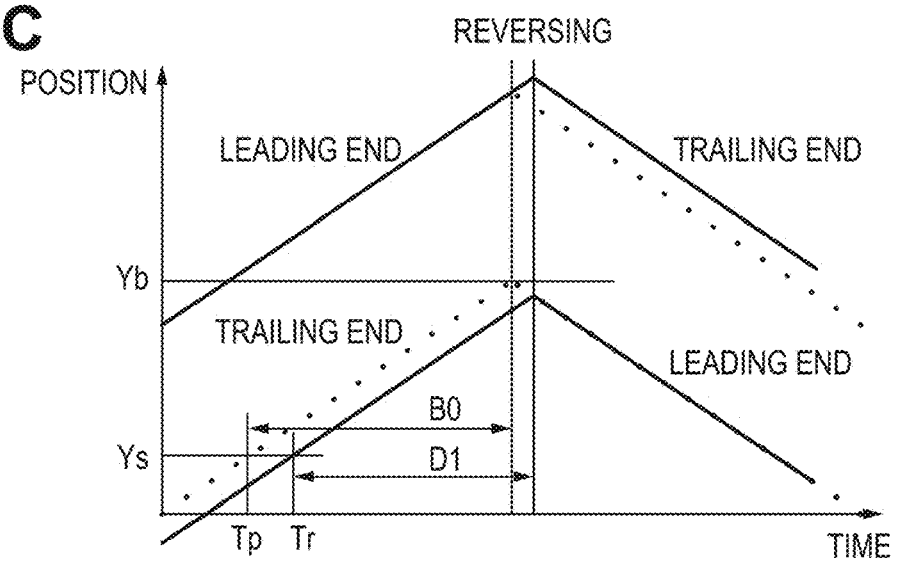

The positions of the sheet P in the reverse processing is illustrated in FIGS. 7A, 7B, and 7C. The horizontal axis represents time. The vertical axis represents the position of the sheet P. FIG. 7A is the same as FIG. 6A and thus will not be described.

FIG. 7B illustrates a case (solid line) where the actual length is longer than the nominal length of the sheet P and the reverse timing has not been corrected. In a case where the actual length is longer than the nominal length of the sheet P, the timing Tr of when the trailing end of the sheet P arrives at the sheet sensor 16 is after the scheduled timing Tp.

The conveyance direction of the sheet P is reversed at a timing corresponding to the predetermined amount of time B0 from the actual timing Tr. As a result, the reverse timing of FIG. 7B is after the reverse timing of FIG. 7A.

FIG. 7C illustrates a case (solid line) where the actual length is longer than the nominal length of the sheet P and the reverse timing has been appropriately corrected. When the predetermined amount of time D1 has elapsed since the actual timing Tr, the conveyance direction of the sheet P is reversed. As a result, the position and the conveyance timing (dashed line) of the leading end (second end) in a case where the actual length and the nominal length are equal and the position and conveyance timing (solid line) of the leading end (second end) in a case where the actual length is longer than the nominal length match.

(7) Maximum Value and Minimum Value Relating to Predetermined Amount of Time C1 and Predetermined Amount of Time D1

Figure 8:
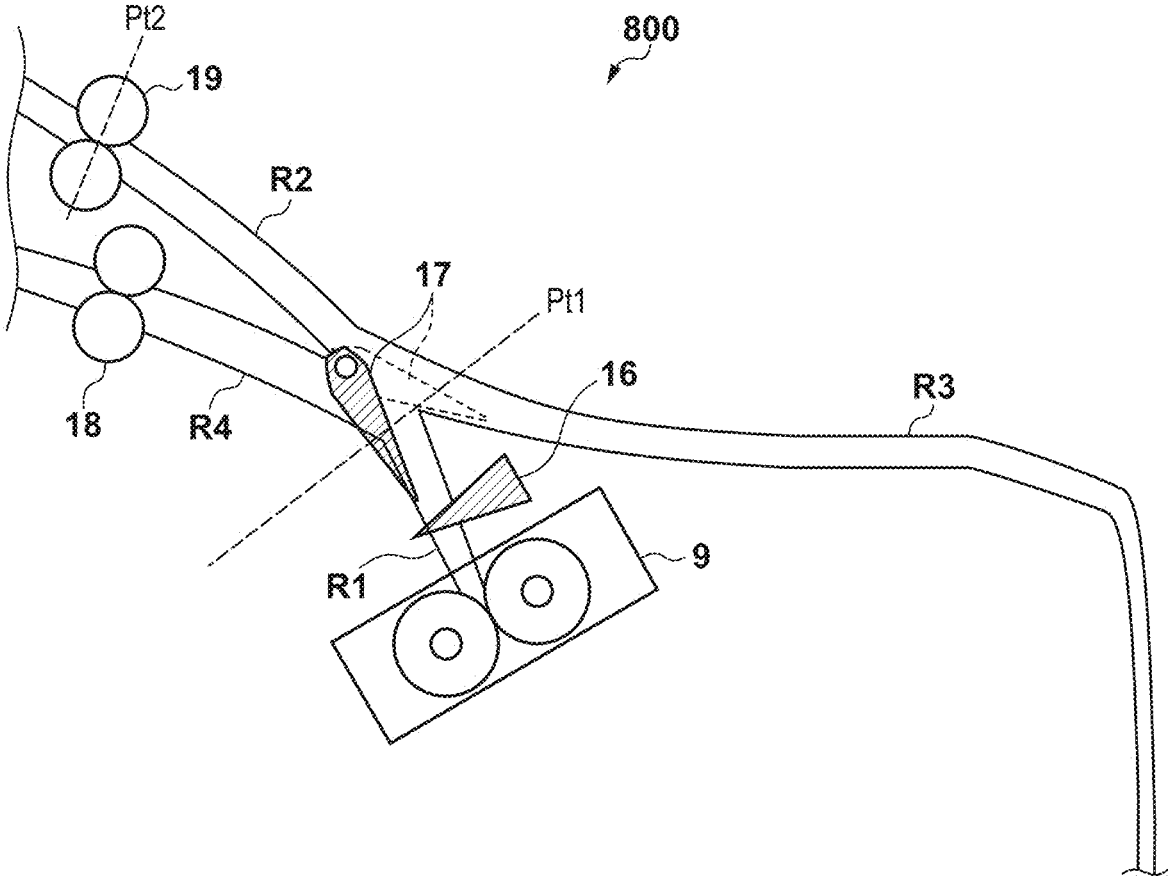
FIG. 8 is an enlarged view of a reversing unit.

FIG. 8 is an enlarged view illustrating a reversing unit 800 of the image forming apparatus 100. A most upstream reversing position Pt1 indicates the most upstream position of the trailing end (second end) of the sheet P where the conveyance direction of the sheet P to be conveyed to the second conveying path R2 can be reversed. In a case where the trailing end is at a position further upstream than here, the trailing end is still located in the first conveying path R1. At this time, when the rotation direction of the reverse roller 19 is reversed, the sheet P is not conveyed to the third conveying path R3 and is conveyed to the first conveying path R1. The sheet P tries to enter the fixing device 9 and a jam occurs.

A most downstream reversing position Pt2 indicates the most downstream position of the trailing end (second end) of the sheet P where the conveyance direction of the sheet P to be conveyed to the second conveying path R2 can be reversed. When the trailing end is conveyed further downstream than the most downstream reversing position Pt2, the sheet P leaves the reverse roller 19 and is discharged to the outside of the image forming apparatus 100.

Thus, the minimum value of the predetermined amount of time C1 and the predetermined amount of time D1 is the conveyance time required for the trailing end of the sheet P to be conveyed from the sheet sensor 16 to the most upstream reversing position Pt1. The maximum value of the predetermined amount of time C1 and the predetermined amount of time D1 is the conveyance time required for the trailing end of the sheet P to be conveyed from the sheet sensor 16 to the most downstream reversing position Pt2.

In this manner, in a case where the actual length and the nominal length of the sheet P are different, the CPU 201 adjusts the reverse timing to remove variation in the conveyance timing of the sheet P in the third conveying path R3. As a result, the image forming apparatus 100 can achieve the target printing speed (throughput).

Second Embodiment

(1) Overview of Second Embodiment

In the first embodiment, the reverse timing of the sheet P is determined according to the actual length of the sheet P. Specifically, in the first embodiment, the predetermined amount of time B0 is corrected to the predetermined amount of time C1 or D1 depending on the result of comparing the actual timing Tr and the scheduled timing Tp for when the trailing end of the sheet P arrives at the sheet sensor 16. In other words, the predetermined amount of time C1 or D1 is calculated on the basis of the actual timing Tr that changes depending on the actual length of the sheet P.

In the second embodiment also, basically the reverse timing of the sheet P is determined according to the actual length of the sheet P. Specifically, in the second embodiment, the actual length of the sheet P is directly measured using the sheet sensor 13, and the predetermined amount of time B0 is adjusted to a predetermined amount of time C2 or D2 depending on the actual length. In the second embodiment, descriptions of points shared with first embodiment are incorporated by reference.

(2) CPU Functions

Figure 9:
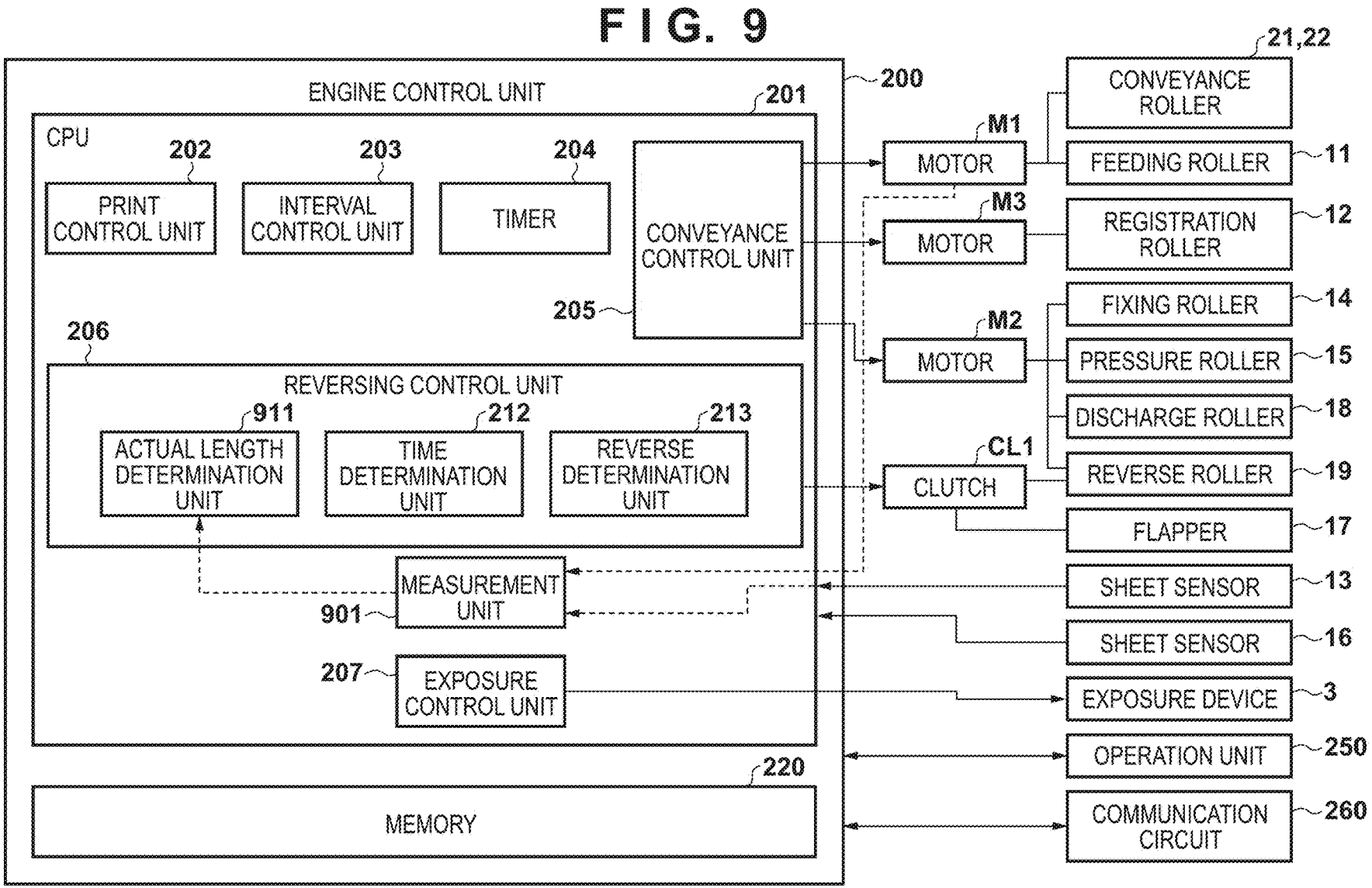
FIG. 9 is a block diagram for describing an engine control unit.

FIG. 9 illustrates the functions implemented by the CPU 201 executing a control program. Descriptions of points shared between FIG. 9 and FIG. 2 are omitted. A measurement unit 901 measures the actual length of the sheet P on the basis of the timing of when the trailing end of the sheet P is detected by the sheet sensor 13. An actual length determination unit 911 determines whether or not the actual length measured by the measurement unit 901 is shorter than the nominal length. The time determination unit 212 determines the conveyance time C2 or D2 on the basis of the determination result of the actual length determination unit 911. The reverse determination unit 213 controls the reversing of the sheet P on the basis of the conveyance time C2 or D2.

(3) Flowchart (3-1) Actual Length Measurement Method

Figure 10:
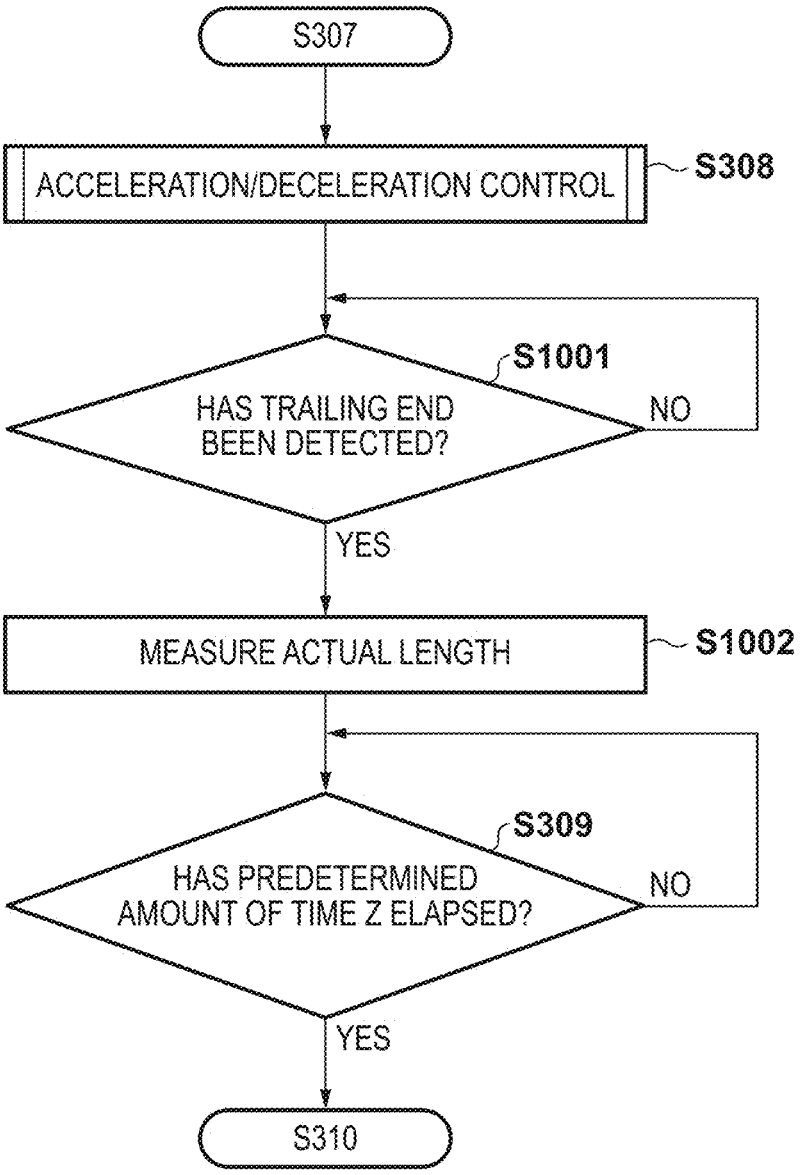
FIG. 10 is a flowchart illustrating an actual length measurement method.

FIG. 10 is a flowchart illustrating the actual length measurement method according to the second embodiment. S1001 and S1002 are added between S308 and S309 in the flowchart illustrated in FIGS. 3A and 3B. After the acceleration/deceleration control of S308 has ended and the conveyance speed of the sheet P is returned to the specified speed V, the CPU 201 proceeds from S308 to S1001.

In S1001, the CPU 201 (measurement unit 901) determines whether or not the trailing end of the sheet P has been detected by the sheet sensor 13. When the trailing end of the sheet P is detected, the CPU 201 proceeds from S1001 to S1002.

In S1002, the CPU 201 (measurement unit 901) measures the actual length of the sheet P. An actual length Pb may be obtained by the following mathematical formula Eq8 so as to not be affected by the acceleration/deceleration control.

$$Pb = (Z3 + (Z2 - Z1)) \times V \quad \text{Eq 8}$$

Here, Z1 is the time when the leading end of the sheet P arrived at the secondary transfer roller 8. Z1 is obtained by obtaining the conveyance time by dividing the (known) distance of the section from the sheet sensor 13 to the secondary transfer roller 8 by the average value of the conveyance speed (predetermined speed V) of the sheet P in this section and adding this conveyance time to the time when the leading end is detected by the sheet sensor 13. Alternatively, Z1 may be the time when the toner image arrives at the secondary transfer roller 8. This is because the acceleration/deceleration control is executed to make the arrival timing of the leading end of the sheet P the same as the arrival timing of the toner image. Y1 may be obtained by adding a fixed value stored in the memory 220 to the time of the start of image formation. Z2 is the time when the trailing end passed through the sheet sensor 13. Z3 is the ideal conveyance time obtained by dividing the distance from the sheet sensor 13 to the secondary transfer roller 8 by the specified speed V. In Formula Eq8, the difference in time between Z2 and Z1 is obtained. Also, the actual length Pb is obtained by multiplying the predetermined speed V by the sum of the difference in time and the conveyance time Z3.

Thereafter, the CPU 201 proceeds from S1002 to S309 and determines whether or not the predetermined amount of time Z has elapsed since the end of the acceleration/deceleration control.

(3-2) Reverse Timing Determination Method

Figure 11:
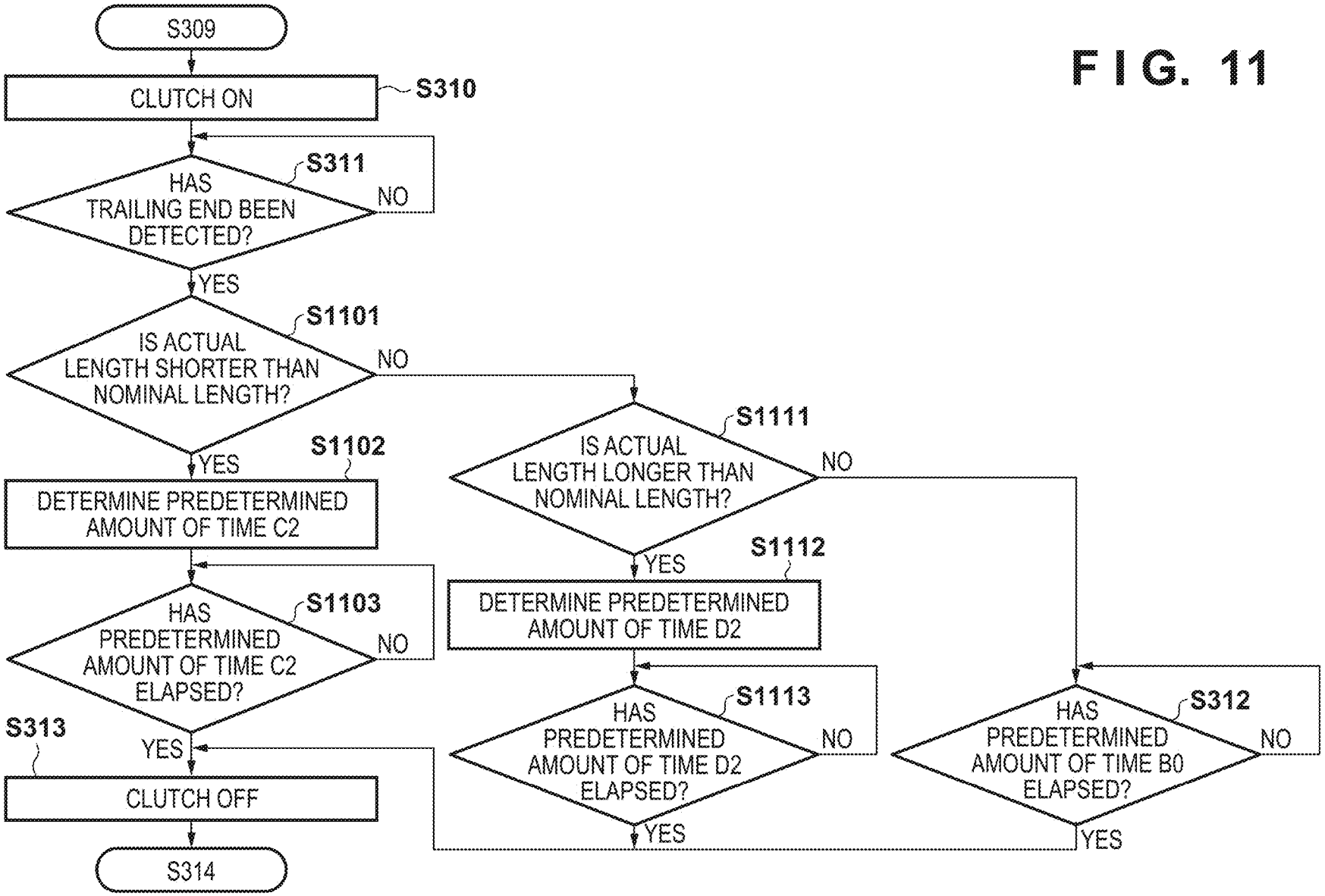
FIG. 11 is a flowchart illustrating a method for adjusting reverse timing.

FIG. 11 illustrates the reverse timing determination method. S1101 to S1113 are added to the processing of S311 to S313. In S311, when the trailing end of the sheet P is detected by the sheet sensor 16, the CPU 201 proceeds from S311 to S1101.

In S1101, the CPU 201 (actual length determination unit 911) determines whether or not the actual length Pb is shorter than the nominal length. In a case where the actual length Pb is shorter than the nominal length, the CPU 201 proceeds from S1101 to S1102.

In S1102, the CPU 201 (time determination unit 212) determines the predetermined amount of time C2. The predetermined amount of time C2 is the conveyance time used instead of the predetermined amount of time B0. The time determination unit 212 determines the predetermined amount of time C2 using the following formula Eq9, for example.

$$C2 = B0 + (Yp2 - Zp) \div 2 \quad \text{Eq 9}$$

Here, Yp2 is the ideal conveyance time obtained by dividing the nominal length of the sheet P by the conveyance speed (specified speed V). Zp is the ideal conveyance time obtained by dividing the actual length Pb by the specified speed V.

In S1103, the CPU 201 (reverse determination unit 213) determines whether or not the predetermined amount of time C2 has elapsed since the timing when the trailing end of the sheet P arrived at the sheet sensor 16 on the basis of the timer 204. When the predetermined amount of time C2 has elapsed, the CPU 201 proceeds from S1103 to S313, and the clutch CL1 is turned off.

On the other hand, in S1101, if the actual length Pb of the sheet P is shorter than the nominal length, the CPU 201 proceeds from S1101 to S1111.

In S1111, the CPU 201 (actual length determination unit 911) determines whether or not the actual length Pb is longer than the nominal length. In a case where the actual length Pb is longer than the nominal length, the CPU 201 proceeds from S1111 to S1112. Note that in a case where the actual length Pb and the nominal length are equal, the CPU 201 proceeds from S1111 to S312.

In S1112, the CPU 201 (time determination unit 212) determines a predetermined amount of time D2. The predetermined amount of time D2 is the conveyance time used instead of the predetermined amount of time B0. The time determination unit 212 determines the predetermined amount of time D2 using the following formula Eq10, for example.

$$D2 = B0 - (Zp - Yp2) \div 2 \quad \text{Eq 10}$$

In S1113, the CPU 201 (reverse determination unit 213) determines whether or not the predetermined amount of time D2 has elapsed since the timing when the trailing end of the sheet P arrived at the sheet sensor 16 on the basis of the timer 204. When the predetermined amount of time D2 has elapsed, the CPU 201 proceeds from S1113 to S313, and the clutch CL1 is turned off.

In this manner, according to the second embodiment, in a case where the actual length Pb and the nominal length of the sheet P are different, the reverse timing is adjusted to reduce variation in the conveyance timing of the sheet P in the second conveying path R2. As a result, the image forming apparatus 100 can achieve the target printing speed (throughput).

Modified Example

In the first embodiment, it is assumed that the conveyance speed of the sheet P before reversing the conveyance direction is the same as the conveyance speed of the sheet P after reversing the conveyance direction. However, this is merely an example. In a case where both conveyance speeds are different, the predetermined amount of time C1 and the predetermined amount of time D1 are merely calculated taking into account the difference in conveyance speed. In other words, the predetermined amount of time C1 and the predetermined amount of time D1 being calculated to make the timing of when the sheet P again arrives at the secondary transfer unit 30 the same as the specified timing is unchanged. Alternatively, it is sufficient that the offset in the conveyance timing of the sheet P relative to the conveyance timing of the toner image when the second end of the sheet P arrives at the sheet sensor 13 is within a range that can be resolved via the acceleration/deceleration control. Thus, the predetermined amount of time C1 and the predetermined amount of time D1 may be calculated so that the offset amount when the leading end (second end) of the sheet P arrives at the sheet sensor 13 is within a range that can be resolved. This also applies to the predetermined amount of time C2 and the predetermined amount of time D2 according to the second embodiment.

The conveyance speed in the third conveying path R3 may also be different depending on the type of the sheet P (for example, plain paper, thin paper, thick paper, and coated paper). Also, the conveyance speed in the third conveying path R3 may also be different depending on an environment condition (for example, temperature and humidity). The conveyance speed in the third conveying path R3 may also be different depending on the deterioration of the durability of the conveyance rollers 21 and 22 and the like. In such cases, the CPU 201 may obtain the conveyance speed in the third conveying path R3 according to the type of the sheet P, an environment condition, or a deterioration state (number of sheets passed or the like) and may correct the reverse timing according to the obtained conveyance speed. Note that the CPU 201 may use a mathematical formula or a table for obtaining the conveyance speed in the third conveying path R3 from the type of the sheet P, an environment condition, or a deterioration state (number of sheets passed or the like). Such a mathematical formula or a table may be obtained in advance via an experiment or simulation and stored in the memory 220.

In the second embodiment, the actual length Pb is measured on the basis of the timing of when the trailing end of the sheet P passes the sheet sensor 13, but this is merely an example. For example, in a case where the motor M1 that drives the feeding roller 11 is a pulse motor, the measurement unit 901 may measure the actual length Pb by counting the pulses supplied to the pulse motor. For example, the measurement unit 901 may measure the actual length Pb from the difference between the count value when the leading end of the sheet P passes through the sheet sensor 13 and the count value when the trailing end of the sheet P passes through the sheet sensor 13.

In the second embodiment, the predetermined amount of time C2 and the predetermined amount of time D2 are determined using the timing of when the trailing end of the sheet P arrives at the sheet sensor 16 as a reference, but this is merely an example. A different sheet sensor provided on the first conveying path R1 or the second conveying path R2 may be used instead of the sheet sensor 16. Also, the timing of when the leading end of the sheet P is detected may be used as a reference instead of the timing of when the trailing end of the sheet P is detected. For example, a different sheet sensor may be installed on the second conveying path R2, and the timing of when the leading end or the trailing end of the sheet P arrives obtained by the sheet sensor may be used as a reference.

Technical Ideas Derived from Embodiments

Item 1

The CPU 201 is an example of a controller that controls a reverse timing of a reverse roller according to an actual length of a sheet. According to the present embodiment, the image forming apparatus 100 provided achieves a target printing speed more easily than known technology due to the reverse timing being controlled according to the actual length of the sheet P.

Item 2

As illustrated in FIGS. 6A, 6B, and 7B, depending on the actual length of the sheet P, the timing of when the trailing end of the sheet P arrives at the sheet sensor 16 is different. Here, the reverse timing is controlled according to the timing of when the trailing end of the sheet P arrives at the sheet sensor 16. Accordingly, a target printing speed is achieved more easily than with known technology due to the reverse timing being controlled according to the actual length of the sheet P.

Item 3

A target printing speed is achieved more easily than with known technology due to the reverse timing being delayed or hastened according to the timing of when the trailing end of the sheet P is detected.

(Items 4 to 6)

As indicated by formulas Eq6 and Eq7, the reverse timing may be accurately determined according to the timing of when the trailing end of the sheet P is detected.

Item 7

By controlling the interval between images being formed on a plurality of pages to be constant, the printing speed of the image forming apparatus 100 is controlled to the target printing speed. For example, by appropriately adjusting the reverse timing of the sheet P, the timing of when an image is formed on the first surface of the sheet P and the timing of when an image is formed on the second surface of the sheet are maintained as constant. As a result, misprints caused by the transfer position of the toner image on the sheet P being offset from the ideal position are less likely to occur.

Item 8

By disposing a detection unit (sensor) between the fixing device 9 and a guidance member (for example, the flapper 17) on the first conveying path, the reverse timing of the sheet P can be accurately corrected. This is because the guidance member is located close to the reversing position of the sheet P and contributes to reversing the sheet P.

Item 9

A clutch that switches the rotation direction of the reversing unit and a clutch that switches the guidance member may be individually provided. However, by controlling both with the single clutch CL1, the number of parts can be reduced.

Item 10

In the first and second embodiment described above, the on and off of the clutch CL1 are each associated with a specific conveyance direction. However, this is merely an example. The relationship between the operation state (on and off) of the clutch CL1 and the conveyance direction may be reversed. By using the clutch CL1 in this manner, the number of motors can be reduced. Note that when the number of motors is reduced, the number of rotary bodies driven by a single motor is increased. In this case, the number of sections on the conveying path that the conveyance speed of the sheet P can be adjusted are reduced, and variation in the arrival timing of the sheet P becomes hard to absorb via acceleration/deceleration control. Thus, adjusting the reverse timing according to the actual length of the sheet P is technically significant.

Item 11

For example, in a case where acceleration/deceleration control of the sheet P is not applied, the actual length of the sheet P is obtained by multiplying the difference between the timing of when the leading end is detected by the sheet sensor 13 and the timing of when the trailing end is detected by the sheet sensor 13 by the specified speed V. Alternatively, via integration of the conveyance speed at which acceleration/deceleration control is applied between the two timings, the actual length is obtained.

Item 12

The sheet sensor 16 is disposed on the downstream side of the sheet sensor 13. In other words, the sheet sensor 13 is disposed on the upstream side of the sheet sensor 16.

Item 13

As illustrated in FIG. 11 and the like, the reverse timing may be adjusted according to the measurement result of the length in the conveyance direction of the sheet P.

Item 14

As illustrated in FIG. 1, the sheet sensor 13 may be disposed on the upstream side of the secondary transfer roller 8. The sheet sensor 16 may be disposed between the fixing device 9 and the flapper 17.

Item 15

Also, according to the second embodiment, the interval between the exposure start timing for the first surface and the exposure start timing for the second surface is controlled to be constant. In this manner, the printing speed of the image forming apparatus 100 may be maintained at the target printing speed. In other words, by adjusting the reverse timing according to the actual length of the sheet P, misprints are reduced, even if the interval between the exposure start timing for the first surface and the exposure start timing for the second surface are maintained as constant.

Item 16

The registration roller 12 is an example of a conveyance unit. For example, the actual length Pb may be calculated by the formula Eq8.

Item 17

As described in relation to formula Eq8, there are various methods for obtaining the time when the leading end of the sheet P arrives at the secondary transfer roller 8. For example, via acceleration/deceleration control, the timing of when the sheet P arrives at the secondary transfer roller 8 is matched to the timing of when the toner image arrives at the secondary transfer roller 8. The toner image is conveyed by the intermediate transfer belt 7 at the specified speed V. Thus, the timing of when the toner image arrives at the secondary transfer roller 8 can be calculated from the exposure start time, the conveyance distance of the toner image, and the specified speed V. Thus, as the timing of when the sheet P arrives at the secondary transfer roller 8, the timing of when the toner image arrives at the secondary transfer roller 8 may be used.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-118515, filed Jul. 20, 2023 which is hereby incorporated by reference herein in its entirety.

What is claimed is:

1. An image forming apparatus comprising:

a housing case housing a sheet;

a discharge tray configured to discharge the sheet;

a first conveying path configured to connect the discharge tray from the housing case;

an image forming unit configured to form an image on the sheet conveyed along the first conveying path;

a second conveying path configured to branch from the first conveying path at a branch position provided downstream of the image forming unit in a conveyance direction of the sheet;

a third conveying path configured to connect the second conveying path and the first conveying path and convey the sheet with an image formed on a first surface from the second conveying path to the first conveying path;

a reverse roller configured to pull in the sheet from the first conveying path to the second conveying path by conveying the sheet in a first direction and deliver the sheet from the second conveying path to the third conveying path by reversing the conveyance direction of the sheet from the first direction to a second direction in order to change a surface where an image is formed by the image forming unit from the first surface to a second surface of the sheet;

a motor configured to drive the reverse roller;

a clutch configured to transmit drive power of the motor to the reverse roller and control a rotation direction of the reverse roller;

a controller configured to control a reverse timing of the reverse roller according to an actual length of the sheet; and a guidance member configured to guide the sheet where an image is formed on the first surface from the first conveying path to the second conveying path and guide the sheet guided to the second conveying path to the third conveying path, wherein the clutch is further configured to control the guidance member.

2. The image forming apparatus according to claim 1, further comprising a sensor configured to detect the sheet conveyed along the first conveying path, wherein the controller is further configured to control the reverse timing of the reverse roller according to a timing of when a trailing end or a leading end of the sheet is detected by the sensor that changes depending on the actual length of the sheet.

3. The image forming apparatus according to claim 2, further comprising an input unit configured to accept an input of a nominal length of the sheet, wherein the controller is further configured to:

delay the reverse timing of the reverse roller if a detection timing by the sensor in accordance with the actual length of the sheet is earlier than a detection timing by the sensor estimated on a basis of the nominal length; and hasten the reverse timing of the reverse roller if a detection timing by the sensor in accordance with the actual length of the sheet is later than a detection timing by the sensor estimated on a basis of the nominal length.

4. The image forming apparatus according to claim 2, further comprising an input unit configured to accept an input of a nominal length of the sheet, wherein the controller is further configured to control the reverse timing of the reverse roller according to a difference between a detection timing by the sensor estimated on a basis of the nominal length and a detection timing by the sensor in accordance with the actual length of the sheet.

5. The image forming apparatus according to claim 4, wherein the controller is further configured to:

control an amount of time from a timing of when the trailing end of the sheet is detected by the sensor to the reverse timing of the reverse roller to be a predetermined amount of time in a case where the actual length of the sheet is the nominal length; and correct the predetermined amount of time according to the difference in a case where the actual length of the sheet is not the nominal length.

6. The image forming apparatus according to claim 5, wherein the controller is further configured to correct the predetermined amount of time by subtracting half of the difference from the predetermined amount of time in a case where the actual length of the sheet is not the nominal length.

7. The image forming apparatus according to claim 2, wherein the image forming unit includes a rotationally driven photosensitive body, an exposure light source configured to form an electrostatic latent image by exposing the photosensitive body to light, a developing roller configured to develop the electrostatic latent image to form a toner image, a primary transfer roller configured to transfer the toner image from the photosensitive body to an intermediate transfer body, a secondary transfer roller configured to transfer the toner image from the intermediate transfer body to the sheet conveyed along the first conveying path, and a fixing roller configured to fix the toner image to the sheet, wherein the sensor is disposed between the fixing roller and the guidance member on the first conveying path.

8. The image forming apparatus according to claim 1, wherein the controller is further configured to maintain a constant interval from a timing of when an image is formed on the first surface of the sheet by the image forming unit to a timing of when an image is formed on the second surface of the sheet by the image forming unit.

9. The image forming apparatus according to claim 1, wherein when the clutch is in a first state, the reverse roller rotates to pull in the sheet from the first conveying path to the second conveying path and the guidance member guides the sheet from the first conveying path to the second conveying path, and when the clutch is in a second state, the reverse roller rotates to deliver the sheet from the second conveying path to the third conveying path and the guidance member guides the sheet from the second conveying path to the third conveying path.

10. The image forming apparatus according to claim 1, further comprising a first sensor configured to detect the sheet conveyed along the first conveying path, wherein the controller is further configured to control the reverse timing of the reverse roller according to the actual length of the sheet obtained from a timing of when a leading end of the sheet is detected by the first sensor and a timing of when a trailing end of the sheet is detected by the first sensor.

11. The image forming apparatus according to claim 10, further comprising a second sensor configured to detect the trailing end of the sheet disposed on a downstream side of the first sensor in the conveyance direction of the sheet on the first conveying path, wherein the controller is further configured to adjust an amount of time from a timing of when the trailing end of the sheet is detected by the second sensor to the reverse timing of the reverse roller according to the actual length of the sheet.

12. The image forming apparatus according to claim 11, further comprising an input unit configured to accept an input of a nominal length of the sheet, wherein the controller is further configured to:

delay the reverse timing of the reverse roller if the actual length of the sheet is shorter than the nominal length; and hasten the reverse timing of the reverse roller if the actual length of the sheet is longer than the nominal length.

13. The image forming apparatus according to claim 12, wherein the image forming unit includes a rotationally driven photosensitive body, an exposure light source configured to form an electrostatic latent image by exposing the photosensitive body to light, a developing roller configured to develop the electrostatic latent image to form a toner image, a primary transfer roller configured to transfer the toner image from the photosensitive body to an intermediate transfer body, a secondary transfer roller configured to transfer the toner image from the intermediate transfer body to the sheet conveyed along the first conveying path, and a fixing roller configured to fix the toner image to the sheet, and wherein the first sensor is disposed on an upstream side of the image forming unit in the conveyance direction of the sheet, and the second sensor is disposed between the fixing roller and the guidance member on the first conveying path.

14. The image forming apparatus according to claim 13, wherein the controller is further configured to maintain a constant interval from a timing of when an electrostatic latent image for the first surface of the sheet is formed by the exposure light source to a timing of when an electrostatic latent image for the second surface of the sheet is formed by the exposure light source.

15. The image forming apparatus according to claim 13, further comprising a conveyance unit disposed on an upstream side of the first sensor in the conveyance direction of the sheet that temporarily accelerates or decelerates a conveyance speed of the sheet to make a timing of when the sheet conveyed along the first conveying path arrives at the image forming unit match a specified timing and that returns the conveyance speed of the sheet back to a predetermined speed, wherein the controller is further configured to calculate the actual length of the sheet by obtaining a time difference between a time of when the leading end of the sheet arrives at the secondary transfer roller and a time of when the trailing end of the sheet arrives at the first sensor, obtaining a conveyance time by dividing a distance from the first sensor on the first conveying path to the secondary transfer roller by the predetermined speed, and multiplying a sum of the conveyance time and the time difference by the predetermined speed.

16. The image forming apparatus according to claim 15, wherein the controller is further configured to use a time of when the toner image arrives at the secondary transfer roller as a time of when the leading end of the sheet arrives at the secondary transfer roller.

* * * * *